US008210824B1

(12) United States Patent
Bucher et al.

(10) Patent No.: US 8,210,824 B1
(45) Date of Patent: Jul. 3, 2012

(54) FULLY KNOCK-DOWN DRUM FAN

(75) Inventors: John C. Bucher, Hillsboro Beach, FL (US); Brian Keith Love, North Lauderdale, FL (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 999 days.

(21) Appl. No.: 12/187,967

(22) Filed: Aug. 7, 2008

Related U.S. Application Data

(60) Provisional application No. 60/954,664, filed on Aug. 8, 2007.

(51) Int. Cl.
*B63H 7/00* (2006.01)
*F04B 53/00* (2006.01)
*F04B 39/00* (2006.01)

(52) U.S. Cl. ..... 416/244 R; 416/210 R; 416/214 R; 416/220 R; 416/247 R

(58) Field of Classification Search ..... 416/210 R, 416/214 R, 220 R, 244 R, 247 R; D23/370, D23/381, 382, 411
See application file for complete search history.

(56) References Cited

U.S. PATENT DOCUMENTS 2,794,509 A * 6/1957 Mix ..... 416/214 R
3,284,021 A * 11/1966 Ryll et al. ..... 242/608.3
5,441,391 A * 8/1995 Frost et al. ..... 417/362
5,944,488 A * 8/1999 Matson ..... 416/247 R
6,213,716 B1 4/2001 Bucher et al.
D480,466 S 10/2003 Bucher et al.
D482,770 S 11/2003 Bucher et al.
D529,165 S 9/2006 Bucher et al.
D531,718 S 11/2006 Bucher et al.
2005/0271516 A1* 12/2005 Chang et al. ..... 416/247 R
* cited by examiner

*Primary Examiner* — J. H. Hur
(74) *Attorney, Agent, or Firm* — Brian S. Steinberger; Law Offices of Brian S. Steinberger, P.A.

(57) ABSTRACT

Methods, devices, systems and apparatus of fully knock-down drum fans that can be shipped completely unassembled so that the smallest packaging is used resulting in more units per container and a lower shipping cost per unit. This allows overseas manufacturers to be more competitive with local manufactures. This is achieved through a drum fan design that utilizes completely modular components that can be assembled quickly and easily either by the distributor of the drum fan or the final end user. A drum fan can include a plural identical shroud curved members, with the same number of pie shaped front grill members, and the same number of pie shaped rear grill members, as well as other modular components that are both easy to nest, pack, store and ship with one another. The knock-down fan will significantly reduce packaging size from approximately 50 to approximately 75% less than current drum fans. The knock-down fan is easy to re-assemble, because of modular components, and the knock-down fan size can be applied to any size drum fan from approximately 24", 36", and 42" up to approximately 60" in diameter.

19 Claims, 27 Drawing Sheets

FULLY KNOCK-DOWN DRUM FAN

This invention claims the benefit of priority to U.S. Provisional Patent Application Ser. No. 60/954,664 filed Aug. 8, 2007.

FIELD OF INVENTION

This invention relates to fans, in particular to devices, apparatus, and methods of providing, modular drum fan that can be separately shipped and easily assembled and dissembled by a distributor and/or by an end user.

BACKGROUND AND PRIOR ART

Drum fans have become popular in recent years for a wide variety of usages. Typically, drum fans that are manufactured overseas are currently shipped in either a fully assembled or partially assembled configuration. With drum fans ranging from approximately twenty four (24") to approximately (60") inches in diameter, the large assembled or partially assembled units require large containers such as rectangular boxes for each of the drum fans.

The large rectangular boxes often have empty space that can take up to approximately 50 to approximately 75 percent of the box. Also, the empty space often needs to have additional packing materials such as but not limited to foam, bubble wrap, and the like. The large amounts of packing space results in fewer units per container and higher shipping cost per unit. This has made manufacturing drum fans overseas at a disadvantage when competing with local competitors.

The problem of requiring extra large packaging containers discussed above occurs again when drum fans needs to be reboxed, stored and/or moved to other locations. Just storing the large oblong drum fans is difficult if a large storage box is not found. Storing the drum fans without a storage container is also not desirable since the unprotected drum fan can become damaged and destroyed if not properly reboxed. Furthermore, the large containers used to hold the drum fans take up extra valuable space for storage as well as take up the valuable space that is needed when the repackaged drum fans are being moved to other locations.

Thus, the need exists for solutions to the above problems.

SUMMARY OF THE INVENTION

A primary objective of the present invention is to provide devices, apparatus, and methods of assembling, dissembling and re-assembling modular components into a drum fan by a retailers and/or distributors and/or and end users.

A secondary objective of the present invention is to provide devices, apparatus, and methods of packaging and shipping modular components of a drum fan in packaging containers that can significantly reduce packaging sizes from about 50% to about 75% less than current shipping containers.

A third objective of the present invention is to provide devices, apparatus, and methods of providing modular components that can be easy to be assembled for any size drum fan ranging from about 24" in diameter to approximately 60" in diameter or more.

A preferred embodiment of the knock-down drum fan, can include a cylindrical shroud housing having a plurality of identical curved members that attach to one another end to end to form the cylindrical shroud, a front grill having a plurality of identical generally triangular shaped members that together form the front grill, fan blades having a plurality of identical blade members that together form the fan blades, a rear grill having a plurality of identical generally triangular shaped members that together form the rear grill, a hub for supporting fan blades within the cylindrical shroud housing between the front grill and the rear grill, a motor inside of the cylindrical shroud housing for rotating the blades, a front cap for covering a central opening in the front grill, and wheels attached beneath the cylindrical shroud for allowing the drum fan to be mobile, wherein the drum fan is assembled from shroud housing, the front cap, the front grill, the rear grill, the hub, the fan blades, the motor, the back grill and the wheels.

The shroud housing can consist essentially of four identical shroud members that assembled together form the cylindrical shroud housing. Both the front grill and the rear grill can each consist essentially of four equal shaped grill members, the members being generally triangular and pie shaped.

The shroud housing can also consist essentially of six identical shroud members that assembled together form the cylindrical shroud housing. Both the front grill and the rear grill can each consist essentially of six equal shaped grill members.

Each of the identical generally triangular shaped members of the front grill and the rear grill attach can be attached to the cylindrical shroud housing with interconnecting members that allow the front grill and the rear grill to snap into place within the identical shroud members.

Additionally, each of the identical generally triangular shaped members of the front grill and the rear grill attach can be attached to the cylindrical shroud housing with overlapping curved connecting members that allow the front grill and the rear grill to be held into place within the identical shroud members.

Additionally, each of the identical generally triangular shaped members of the front grill and the rear grill attach can be attached to the cylindrical shroud housing with connecting members that connect together with threaded fasteners to allow the front grill and the rear grill to be held into place within the identical shroud members.

The knock-down drum fan can also include a plurality of handles attached to upper portions of the identical shroud members. The knock-down drum fan can also include a plurality of front external brace members adjacent to sides of each of the identical grill members, for holding the front grill together, the plurality of front external brace members being identical in number to the plurality of the front grill members, and a plurality of rear external brace members adjacent to sides of each of the identical grill members, for holding the rear grill together, the plurality of rear external brace numbers being identical in number to the plurality of rear grill members.

The blades can include identical blade members, where the blades can also nest with one another when not being used.

A method of knocking down a drum fan into a compact disassembled drum, can include the steps of nesting identical curved housing shroud members of the disassembled drum fan together in a stacked arrangement, nesting together identical drum fan blades together, separating a front grill into plural identical parts, separating a rear grill into plural identical parts, separating a motor and a hub, compacting the stacked curved housing shroud members with the nested identical drum fan blades and the separated front and rear grill parts and separated motor and hub into a space that is approximately 50 to approximately 75 percent smaller than space needed for an assembled drum fan.

The identical curved housing shroud members, the plural identical front grill parts and the plural identical rear grill parts, can each include four identical curved shroud members, four identical pie shaped front grill members, and four identical pie shaped rear grill members.

The identical curved housing shroud members, the plural identical front grill parts and the plural identical rear grill parts, can each include six identical curved shroud members, six identical pie shaped front grill members, six identical pie shaped rear grill members.

As an additional safety measure, pliable and bendable fasteners, such as plastic tie wraps, and/or other, bendable and pliable wires, strings, and other materials can be used to further attach each of the front grill members/components to each other and/or to other parts of the drum fan, such as the shroud cover, braces, and other structural supports.

The method can include assembling the identical curved housing shroud members into a cylinder shaped outer housing. Methods of assembling the modular components can be easily accomplished by distributors, retailers, and/or end users.

Further objects and advantages of this invention will be apparent from the following detailed description of the presently preferred embodiments which are illustrated schematically in the accompanying drawings.

DESCRIPTION OF THE PREFERRED EMBODIMENTS

Figures 1, 1A:
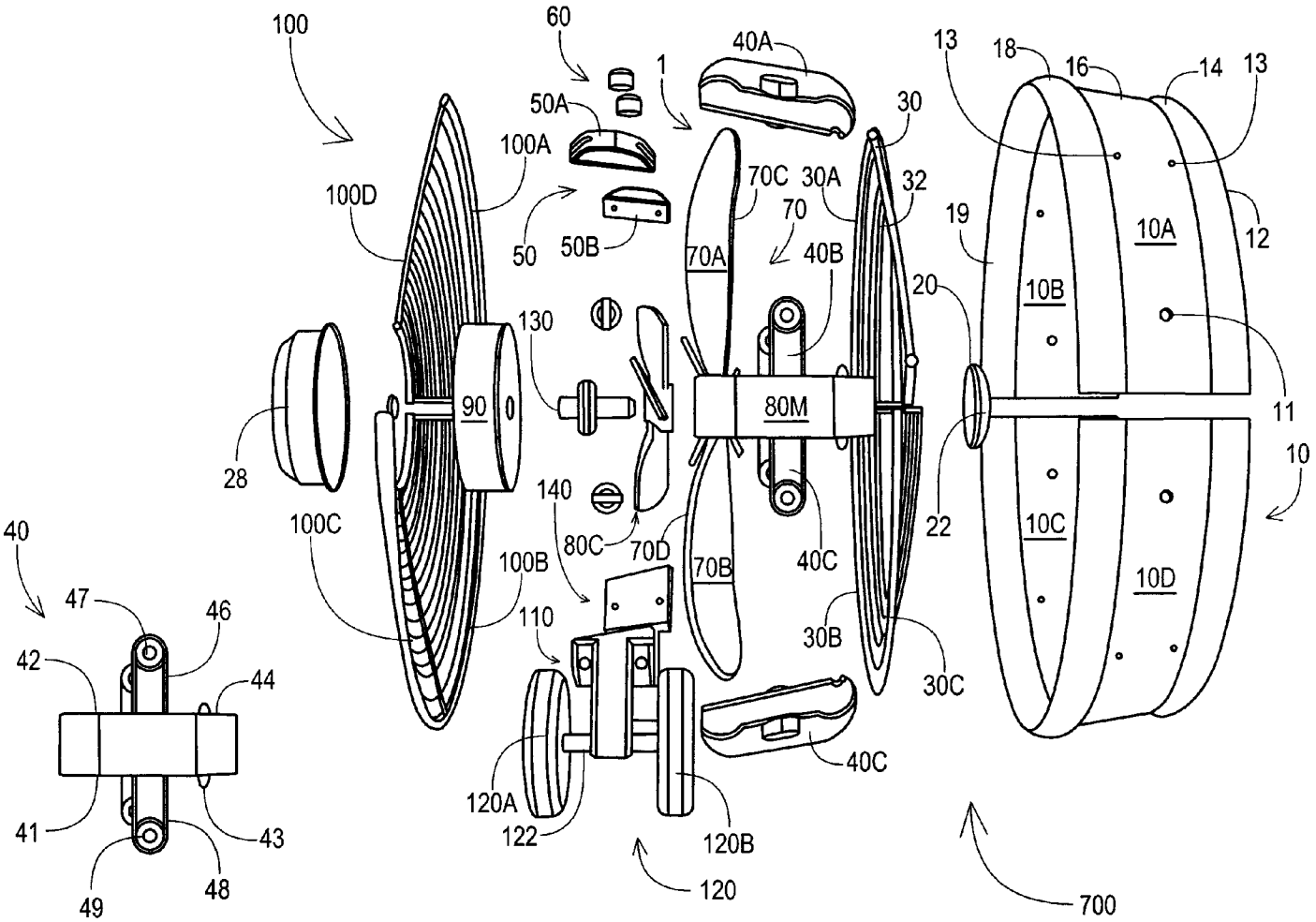
FIG. 1 is a perspective exploded view of the novel modular components of a first embodiment of the knock down drum fan.
FIG. 1A is an enlarged bottom view of a single assembled cross-brace for use in FIG. 1.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing description of the components will now be described.

| | |
|---|---|
| 1 | modular drum fan components |
| 10 | shroud |
| 11 | mounting holes for braces |
| 12 | front opening |
| 13 | mounting holes for handles |
| 14 | front outer ring |
| 16 | outwardly expanding mid-section |
| 18 | rear outer ring |
| 10A | first shroud member |
| 10B | second shroud member |
| 10C | third shroud member |
| 10D | fourth shroud member |
| 20 | front grill cap |
| 22 | outer face cover |
| 28 | rear backplate |
| 30 | front grill |
| 32 | male edge connector |
| 38 | female edge connector |
| 30A | first grill member |
| 30B | second grill member |
| 30C | third grill member |
| 30D | fourth grill member |
| 40 | Main Cross Braces |
| 40A | first brace member |
| 40B | second brace member |

-continued

| | |
|---|---|
| 40C | third brace member |
| 40D | fourth brace member |
| 50 | handles |
| 50A | first handle member |
| 50B | second handle member |
| 60 | fasteners/bolts |
| 70 | fan blades |
| 70A | first fan blade |
| 70B | second fan blade |
| 70C | third fan blade |
| 70D | fourth fan blade |
| 80B | main hub |
| 80C | hub cap |
| 90 | motor |
| 100 | back grill |
| 100A | first back grill member |
| 100B | second back grill member |
| 100C | third back grill member |
| 100D | fourth back grill member |
| 110 | wheel brace |
| 120 | wheels |
| 130 | motor shaft |
| 140 | front leg |
| 200 | Second Embodiment Knock Down Drum Fan |
| 210 | shroud |
| 210A | first shroud member |
| 210B | second shroud member |
| 210C | third shroud member |
| 210D | fourth shroud member |
| 212 | male connector protruding end |
| 213 | raised side ridges on front sides of shroud members |
| 215 | internal facing raised flanges |
| 217 | raised side ridges on rear sides of shroud members |
| 218 | female receptacle connector end |
| 220 | front grill cap |
| 225 | circumferential groove |
| 228 | rear grill ring |
| 230 | front grill |
| 230A | first front grill member |
| 230B | second front grill member |
| 230C | third front grill member |
| 230D | fourth front grill member |
| 240 | front grill braces |
| 240A | first front grill brace |
| 240B | second front grill brace |
| 240C | third front grill brace |
| 242 | inner male protruding tip |
| 248 | bent hook end |
| 250 | handles |
| 250A | front upper handle |
| 250B | rear upper handle |
| 260 | internal hub attached braces |
| 260A | first internal brace |
| 260B | second internal brace |
| 260C | third internal brace |
| 260D | fourth internal brace |
| 262 | outer male tip ends |
| 265 | inner arc members |
| 266 | male protruding end |
| 267 | female receptacle end |
| 270 | fan blades |
| 270A | first fan blade pair |
| 270B | second fan blade pair |
| 272 | blade end |
| 274 | central plate portion with flat surface |
| 275 | through-hole |
| 278 | blade end |
| 280 | hub |
| 280M | non-rotatable main hub |
| 280C | hub cap |
| 280R | rotatable hub portion |
| 280P | rotatable axle pin |
| 284 | outer circumferential grooves |
| 290 | motor inside of hub |
| 300 | back grill |
| 300A | first back grill member |
| 300B | second back grill member |

-continued

| | |
|---|---|
| 300C | third back grill member |
| 300D | fourth back grill member |
| 310 | wheel braces |
| 310A | first wheel brace |
| 310B | second wheel brace |
| 320 | wheels |
| 320A | first wheel |
| 320B | second wheel |
| 340 | Rear/back grill braces |
| 340A | first rear grill brace |
| 340B | second rear grill brace |
| 340C | third rear grill brace |
| 342 | inner male protruding tip |
| 348 | bent hook end |
| 350 | front leg |
| 352 | bent outer ends |
| 355 | flat mid portion |
| 357 | rubber/elastomer tip |
| 400 | third embodiment |
| 410 | shroud |
| 410A | first shroud member |
| 410B | second shroud member |
| 410C | third shroud member |
| 410D | fourth shroud member |
| 410E | fifth shroud member |
| 410F | sixth shroud member |
| 412 | first overlapping end |
| 413 | front side bent edges on front sides of shroud members |
| 417 | rear side bent edges on rear sides of shroud members |
| 418 | second overlapping connector end |
| 430 | front grill |
| 430A | first front grill member |
| 430B | second front grill member |
| 430C | third front grill member |
| 430D | fourth front grill member |
| 430E | fifth front grill member |
| 430F | sixth front grill member |
| 432 | inner flat arc end |
| 438 | outer flat arc end |
| 439 | through-holes |
| 450 | handles |
| 450A | front upper handle |
| 450B | rear upper handle |
| 470 | fan blades |
| 470A | first fan blade pair |
| 470B | second fan blade pair |
| 472 | blade end |
| 474 | central plate portion with flat surface |
| 475 | through-hole |
| 500 | back grill |
| 500A | first back grill member |
| 500B | second back grill member |
| 500C | third back grill member |
| 500D | fourth back grill member |
| 500E | fifth back grill member |
| 500F | sixth back grill member |
| 502 | inner flat arc end |
| 508 | outer flat arc end |
| 509 | through holes |
| 510 | I-shaped wheel brace |
| 512 | header portion |
| 510A | first wheel axle |
| 510B | second wheel axle |
| 520 | wheels |
| 520A | first wheel |
| 520B | second wheel |
| 550 | front I shaped leg |
| 552 | top attachment end |
| 555 | bottom footer |
| 600 | packing box |
| 700 | tie wraps and fasteners |

First Embodiment

FIG. 1 is a perspective exploded view of the novel knock down modular components of the unassembled drum fan 1.

Figure 3:
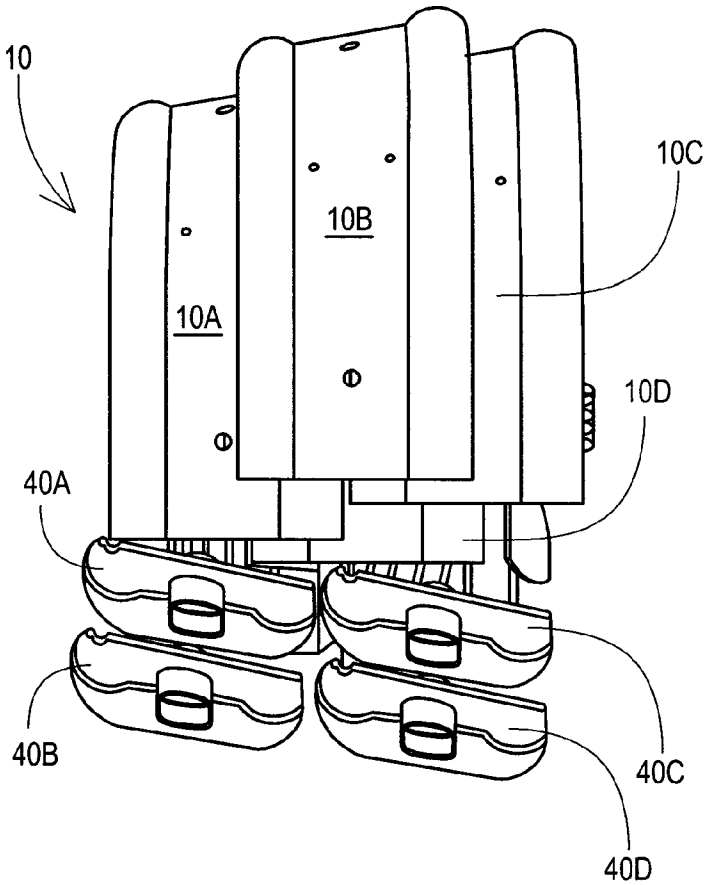
FIG. 3 is a side view of the packed drum fan components of FIG. 1 along arrow X1.
Figure 2:
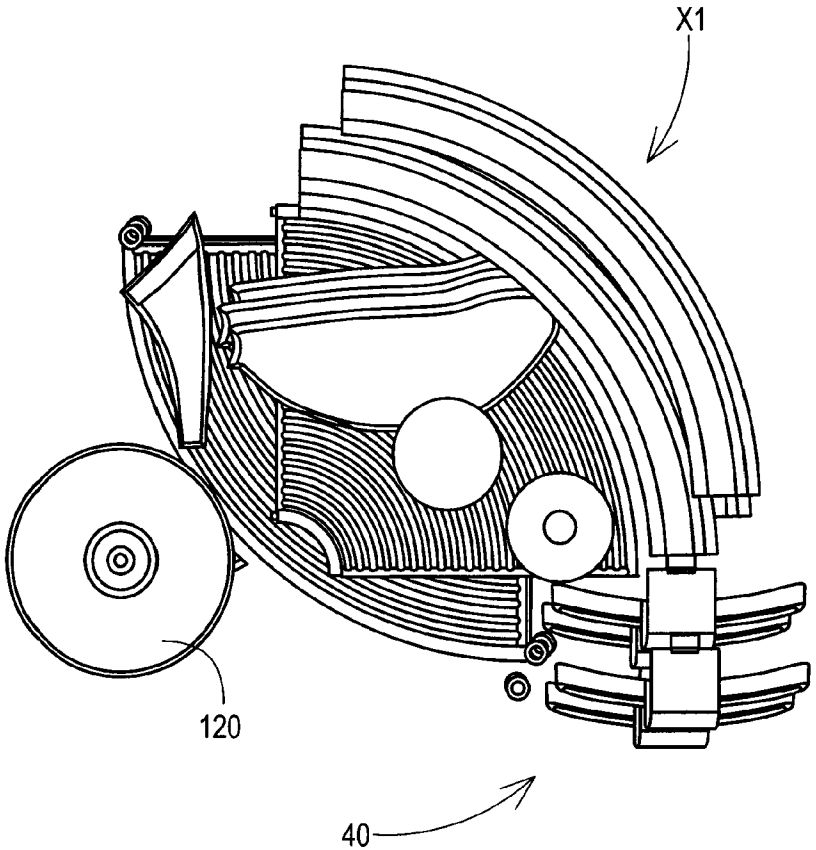
FIG. 2 is a side view of the modular drum fan components of FIG. 1 packed together.
Figure 4:
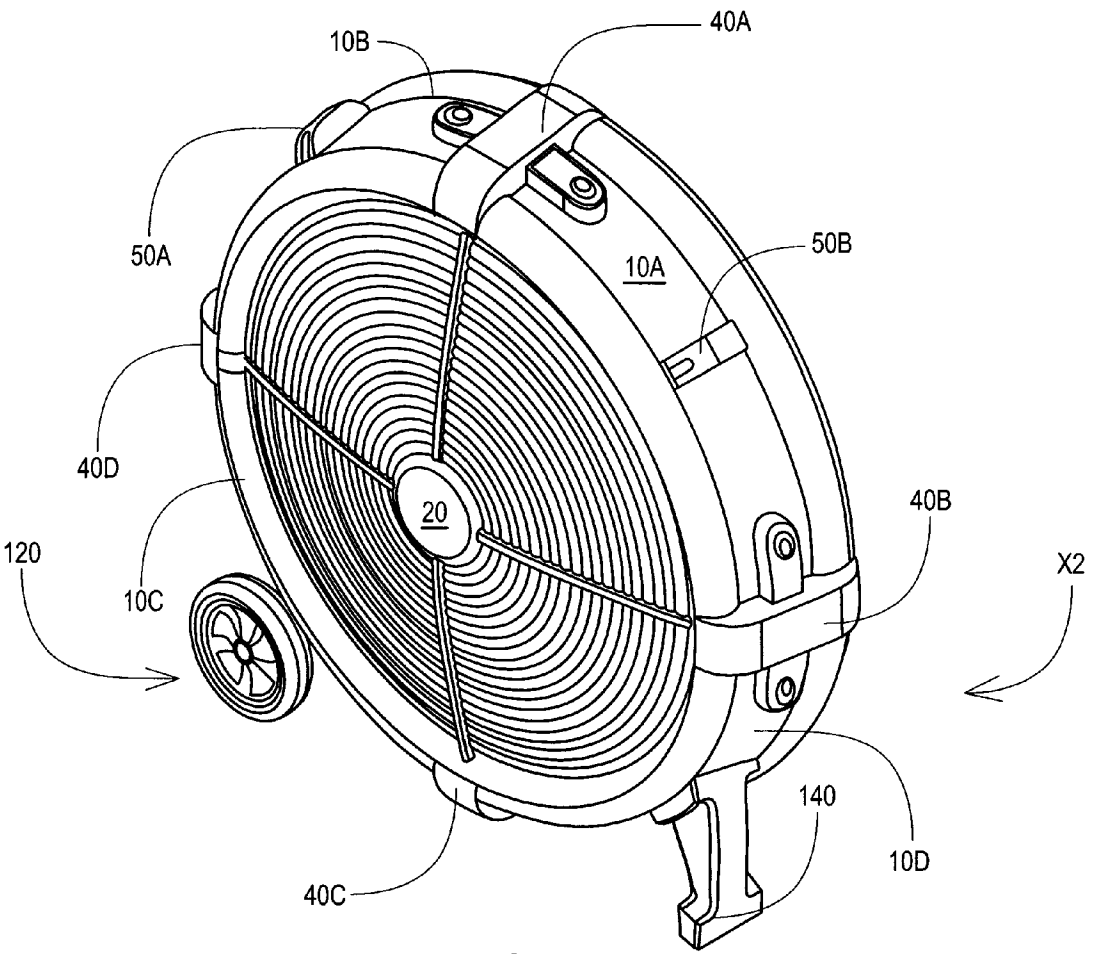
FIG. 4 is a perspective front left view of the first embodiment assembled drum fan using the modular components of the preceding figures.
Figure 6:
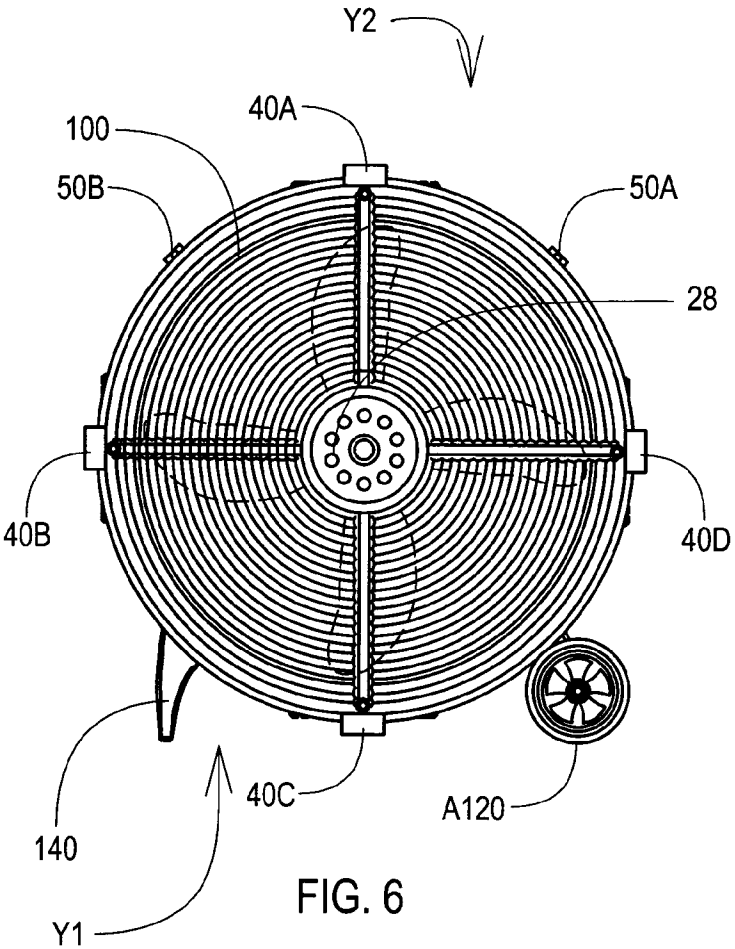
FIG. 6 is a right side view of the assembled drum fan of FIG. 4.
Figure 5:
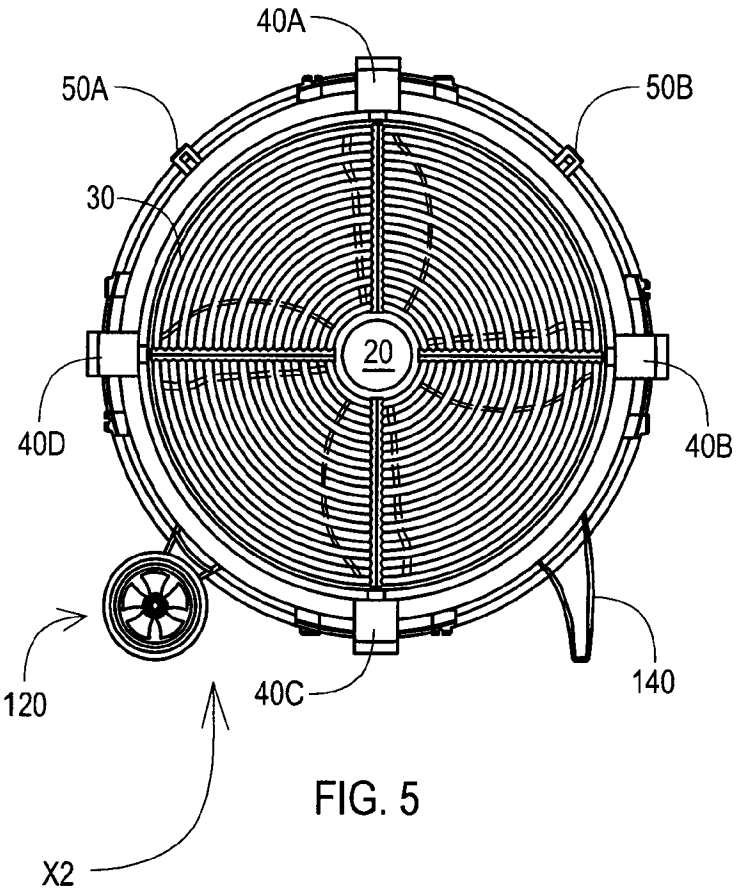
FIG. 5 is a left side view of the assembled drum fan of FIG. 4.
Figure 7:
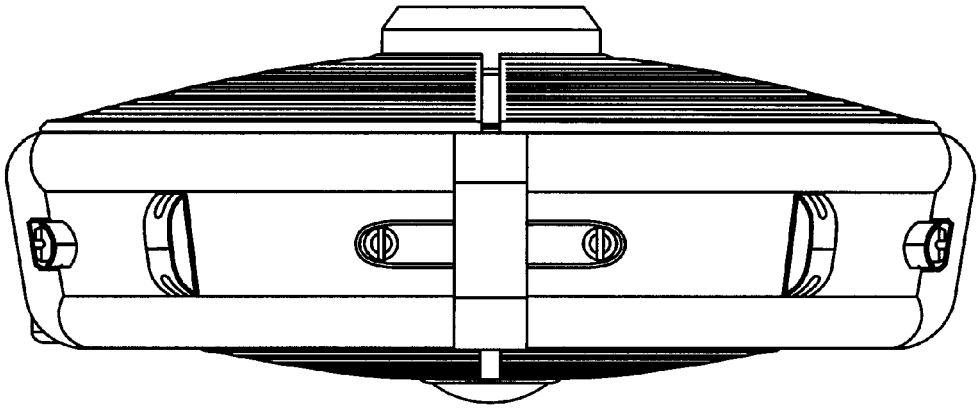
FIG. 7 is a bottom view of the assembled drum fan of FIG. 6 along arrow Y1.
Figure 8:
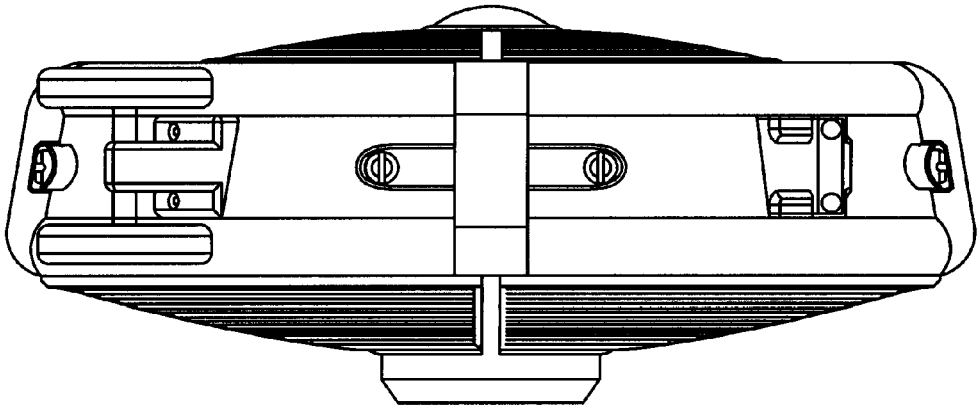
FIG. 8 is a front end view of the assembled drum fan of FIGS. 4-5 along arrow X2.
Figure 9:
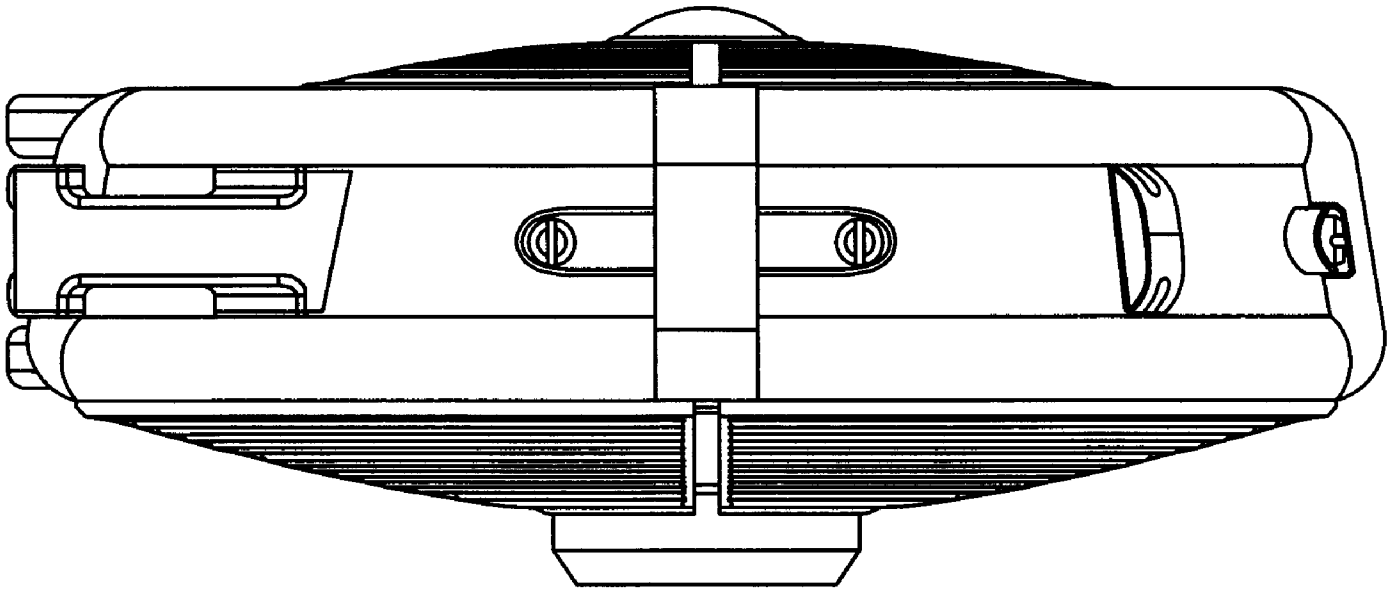
FIG. 9 is a top view of the assembled drum fan of FIG. 6 along arrow Y2.

FIG. 1A is an enlarged bottom view of a single assembled cross-brace 40 for use in FIG. 1. FIG. 2 is a side view of the modular drum fan components 1 of FIG. 1 packed together for transportation and/or storage. FIG. 3 is a side view of the packed drum fan components of FIG. 1 along arrow X1. FIG. 4 is a perspective front left view of an assembled drum fan 1 using the modular components of the preceding figures. FIG. 5 is a left side view of the assembled drum fan 1 of FIG. 4. FIG. 6 is a right side view of the assembled drum fan 1 of FIG. 4. FIG. 7 is a bottom view of the assembled drum fan 1 of FIG. 6 along arrow Y1. FIG. 8 is a front end view of the assembled drum fan 1 of FIGS. 4-5 along arrow X2. FIG. 9 is a top view of the assembled drum fan of FIG. 6 along arrow Y2.

Referring to FIGS. 1-9, the drum fan 1 can be broken down into modular components that can include a shroud 10 that can break down into four shroud piece members 10A, 10B, 10C and 10D. When put together the four members 10A-10D can form a cylinder shape using the assembled cross braces 40(40A, 40B, 40C and 40D). Each shroud piece member (10A-10D) are identical and can each include front end ring with outer rounded convex surface and a lower concave surface, an outwardly expanding mid-section 16, and a rear end ring having an outer rounded convex surface and a lower concave surface. Each shroud member (10A-10D) includes identically located mounting holes 13. The identical shapes of each of the shroud members 10A-10D allows for ease in manufacturing purposes, as well as allows for the shroud members 10A-10D to be able stack with each other and nest with one another as shown in FIG. 3. When assembled into a cylindrical shape, the shroud has a front opening 12 to the cylindrical shape that opens up to a larger rear opening 19.

The front grill 30 can be assembled from four identically shaped grill members 30A, 30B, 30C and 30D, (two are shown in FIG. 1) each having a pie shape. One flat side of the pie shape can have a male protruding edge connector 32, while the opposite flat side of each pie shape can have a female mating edge connector 38, such as a receptacle, so that the male edge 32 interlocks into and snaps into place with the female edge connector 38.

A center cap 20 having an outer side 22 (that functions as a front grill cap cover) holds the grill 30 together in the center by snapping into place using a backplate 28. The cap 20 surrounds the center ring of the grill and goes through the first two rings then snapping into the back plate 28.

To be assembled, each of the four equal pie shaped grill members 30A-30D with one male and one female connector snap each other into place, forming a disc shape. The Grill 30 can then fold slightly connecting into the outer ring portions 12 of each of the four separate shroud members 10A-10D, and can be held in place by braces 40.

Referring to FIGS. 1 and 1A, each of the cross braces 40 are used to hold the plural shroud members 10A-10D together and sandwich the front grill 30 into place. The four cross braces 40A, 40B (only two are shown in FIG. 1) hold two bolt holes 47, 49 each that connect it to the shroud members 10A-10D. There are notches 41, 43 in the inner end 42 and outer end 44 of the brace 40 that mimics the raised rings 14, 18 in the shroud members 10A-10D that houses the front grill pieces 30A-30D together.

Two handles 50A, 50B held into place with fasteners 60 such as screws, which attach through the top of the shroud 10. The screw holes 13 are in the same location as the leg 140 and the Wheel Brace 110.

Other fasteners 60 such as bolts, screws, nuts, and the like, can be used to hold the braces 40 to the shroud 10, as well as assemble other components to one another.

The fan blades 70 can include four equal blades 70A, 70B, 70C and 70D that each can fold into each other with an offset. Blades have the ability to nest together with a moveable hub 80C, 80B for packaging. The blades 70A, 70B, 70C and 70D can also be taken off for packaging if necessary.

A hub 80 can be used to hold the blades 70 with three bolts. The Hub 80M has a moveable feature on offset arms 80C that nest beneath the other two arms. The drum fan 1 can include a motor 90 such as approximately ½ for smaller fans up to approximately 1 horsepower motor for larger fans.

The back grill 100 can be formed from four equal pie shaped members 100A, 100B, 100C and 100D that each have male and female holes and inserts that hold the grill together similar to the front grill components 30. The back grill 100 can be then held into place by fasteners 60, such as screws that enter through the holes and into the back of the shroud 10. The back grill 100 can have inserts on the back to hold the motor 90. The motor 90 will help to hold the structure of the Grill together.

The wheel brace 110 can be attached to the shroud 10 with bolt holes in the same location as the handle 50A, 50B and the Front Leg 140. Wheel brace 110 has a center hole that holds the shaft for the wheels. The wheels 120 can include a pair of wheels 120A, 120B connected by a shaft 122 with center ball bearing to a mount 126. Each of the wheels can include solid rubber tires for an extended life.

A motor shaft 130 connects the motor 90 to the shroud 10, and the shaft 130 can be placed in the motor 90 for shipping. The motor shaft 130 has a connector that houses the Hub 80 for break down capability.

The front leg 140 mimics the shape of the shroud 10 held into place with the same holes as the handle 50A, 50B and the Wheel Brace 110. The front leg 140 is used to hold the assembled fan 1 in place on a floor surface and to balance the assembled Fan.

As an additional safety measure a plurality of additional flexible and pliable fasteners such as plastic tie wraps 700 (FIG. 1) can be used to attach each of the grill section members 30, 100 to each other, and/or to the shroud cover and/or to the hub 80 to better lock the front grill and rear grill in place.

Referring to FIGS. 1-9, the fully knock-down drum fan 1 can be shipped completely unassembled (as shown in FIGS. 2-3) so that the smallest packaging is used resulting in more units per container and a lower shipping cost per unit. This will allow overseas manufacturers to be more competitive with local manufactures. This is achieved through a drum fan modular configuration that utilizes completely modular components that can be assembled quickly and easily either by the distributor of the drum fan or the final end user.

The novel modular configuration of the knock down drum fan can significantly reduce packaging size from to approximately 50 to approximately 75% less than current drum fan products. The modular constructed knock down drum fan is easy to re-assemble, because of its' modular components. The knock down drum fan modular components can be applied to any size drum fan from less than approximately 24" to approximately 60" and larger in diameter.

Second Embodiment

Figure 10:
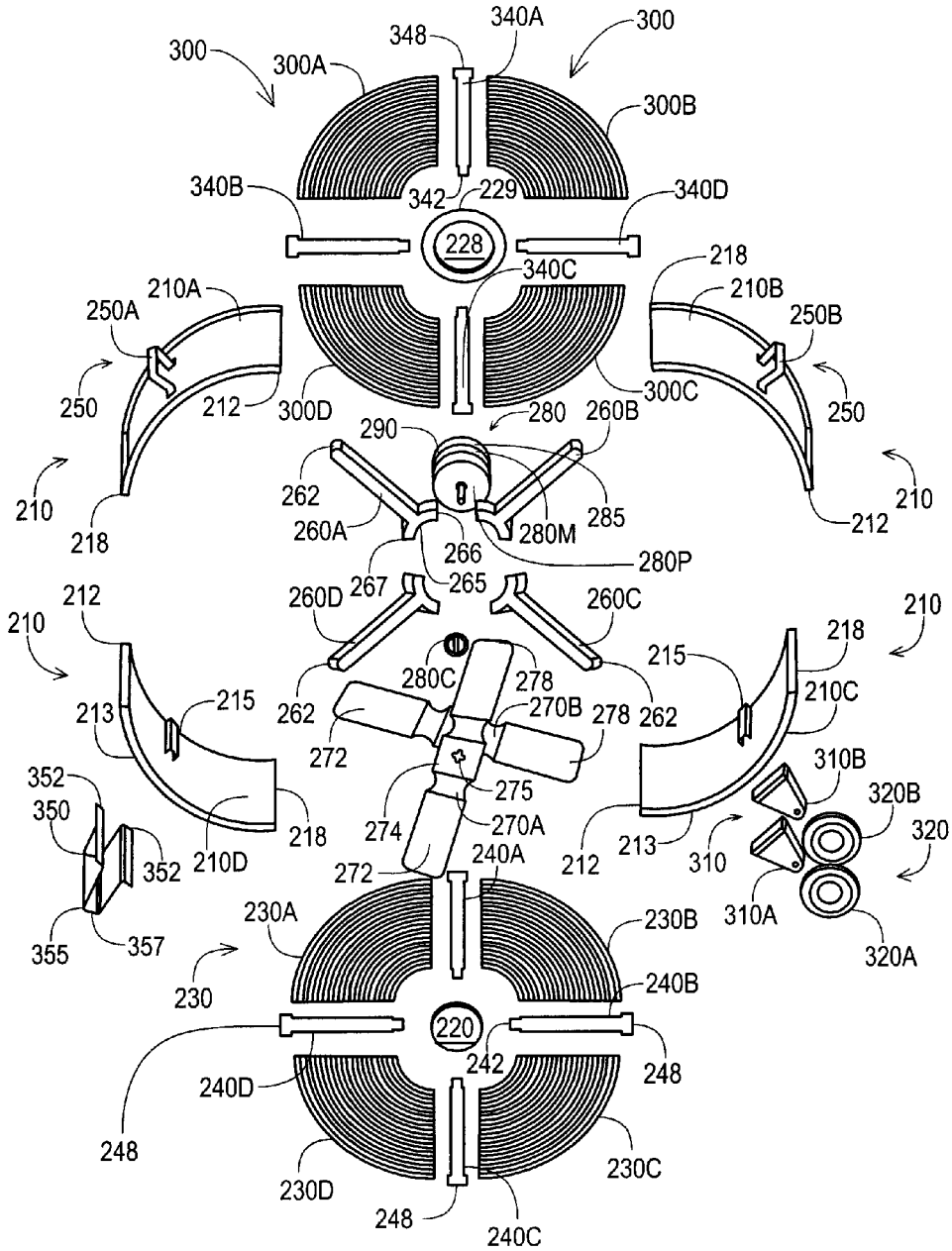
FIG. 10 is an exploded perspective right side view of the novel modular components of a second embodiment of the knock down drum fan.
Figure 11:
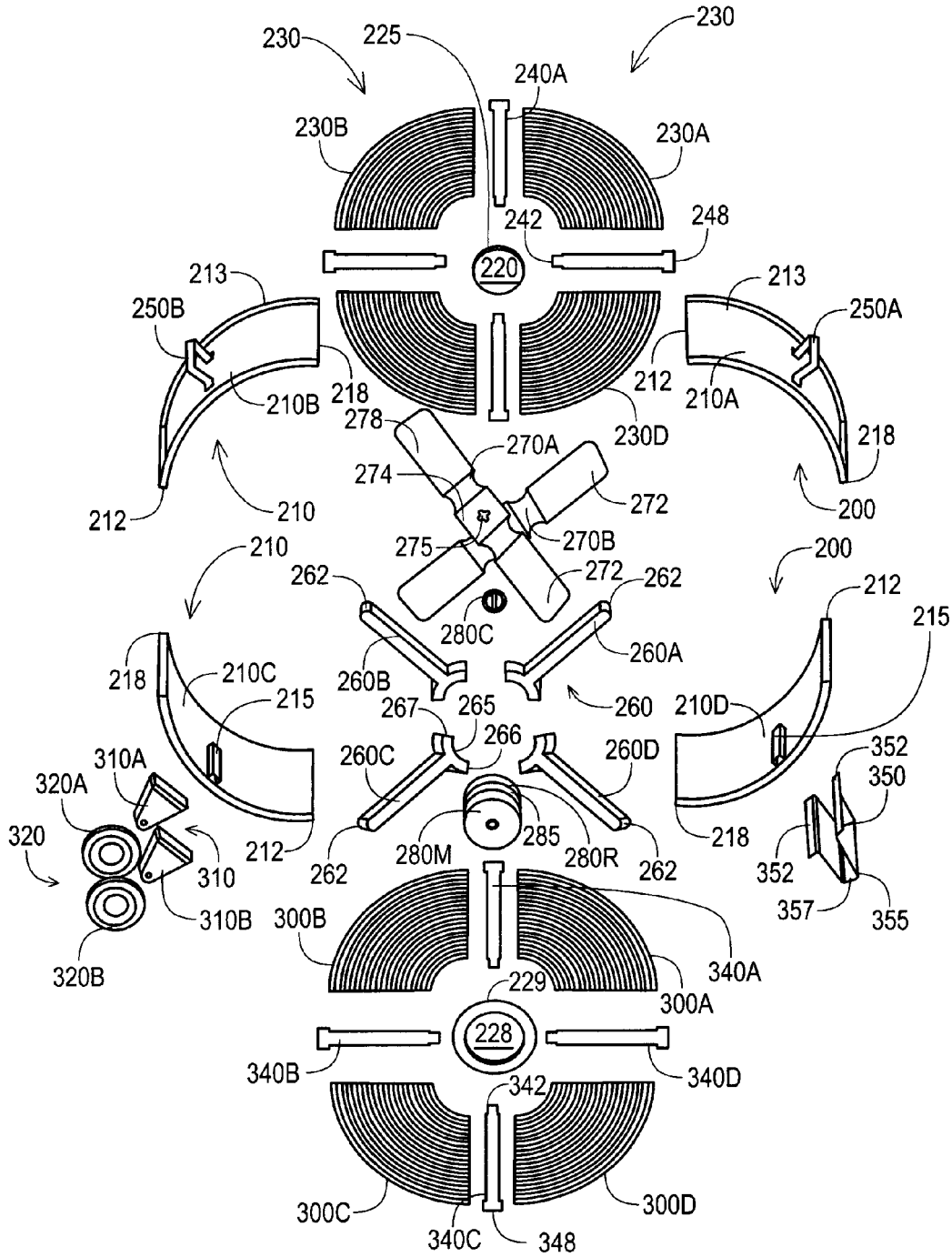
FIG. 11 is an exploded perspective left side view of the knock down fan of FIG. 10.
Figure 12:
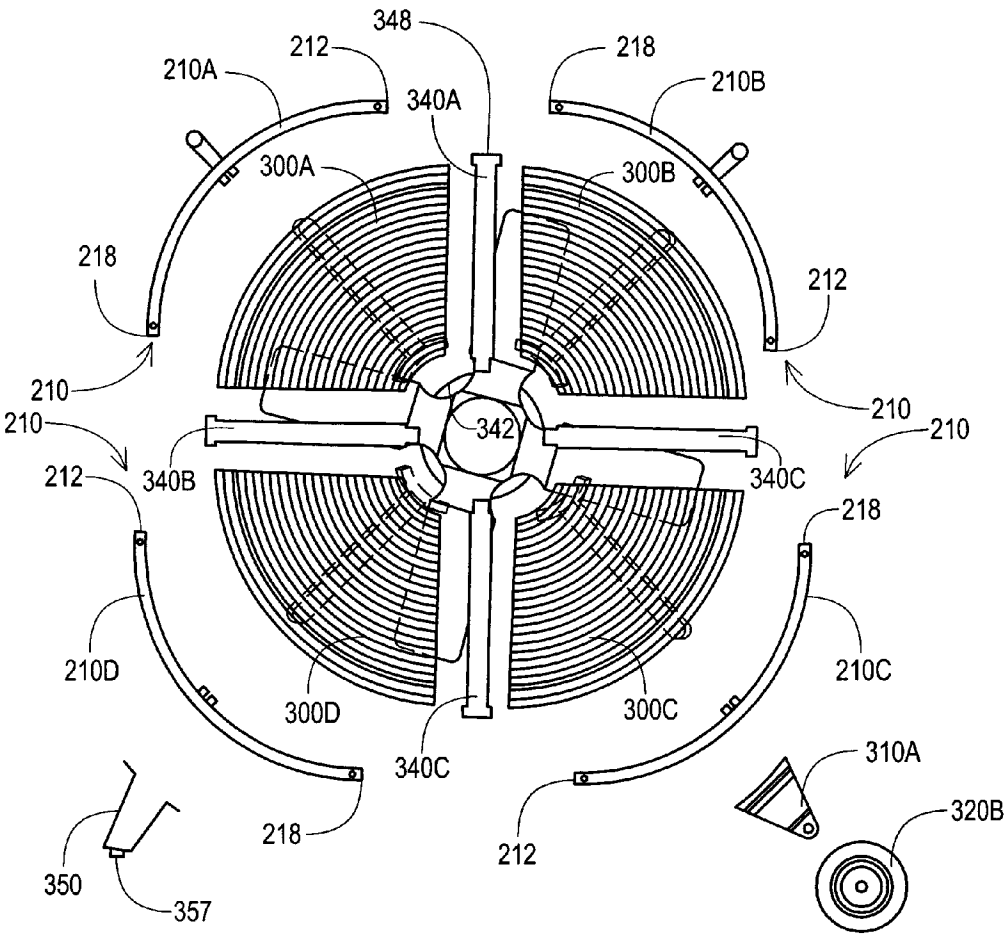
FIG. 12 is an exploded right side view of the knock down fan of FIG. 10.
Figure 13:
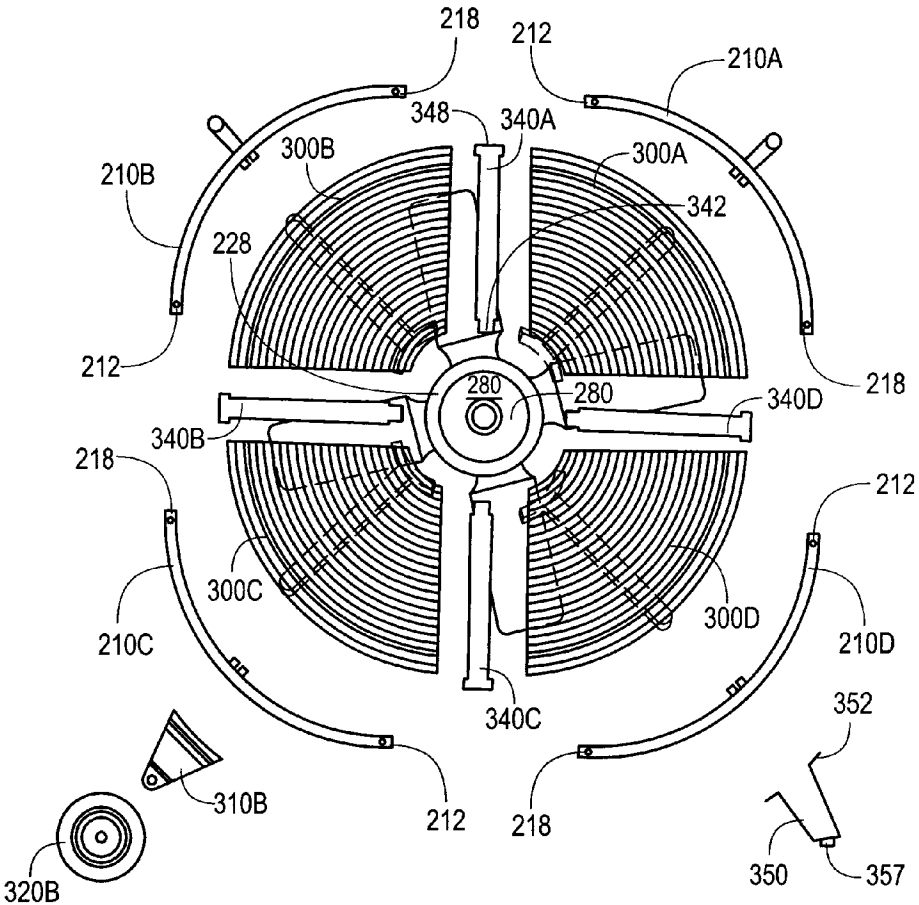
FIG. 13 is an exploded left side view of the knock down fan of FIG. 10.
Figure 14:
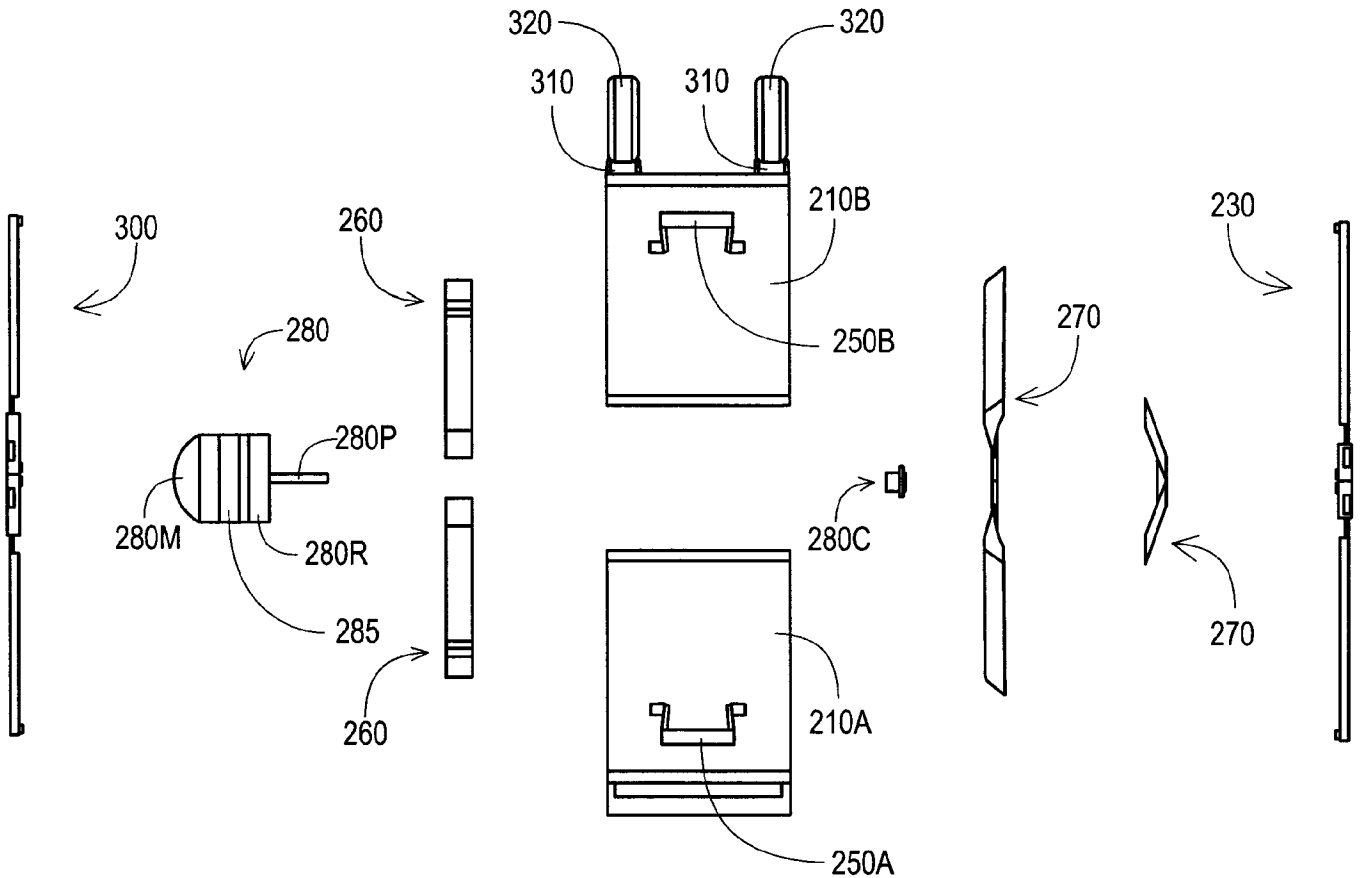
FIG. 14 is an exploded top side view of the knock down fan of FIG. 10.
Figure 15:
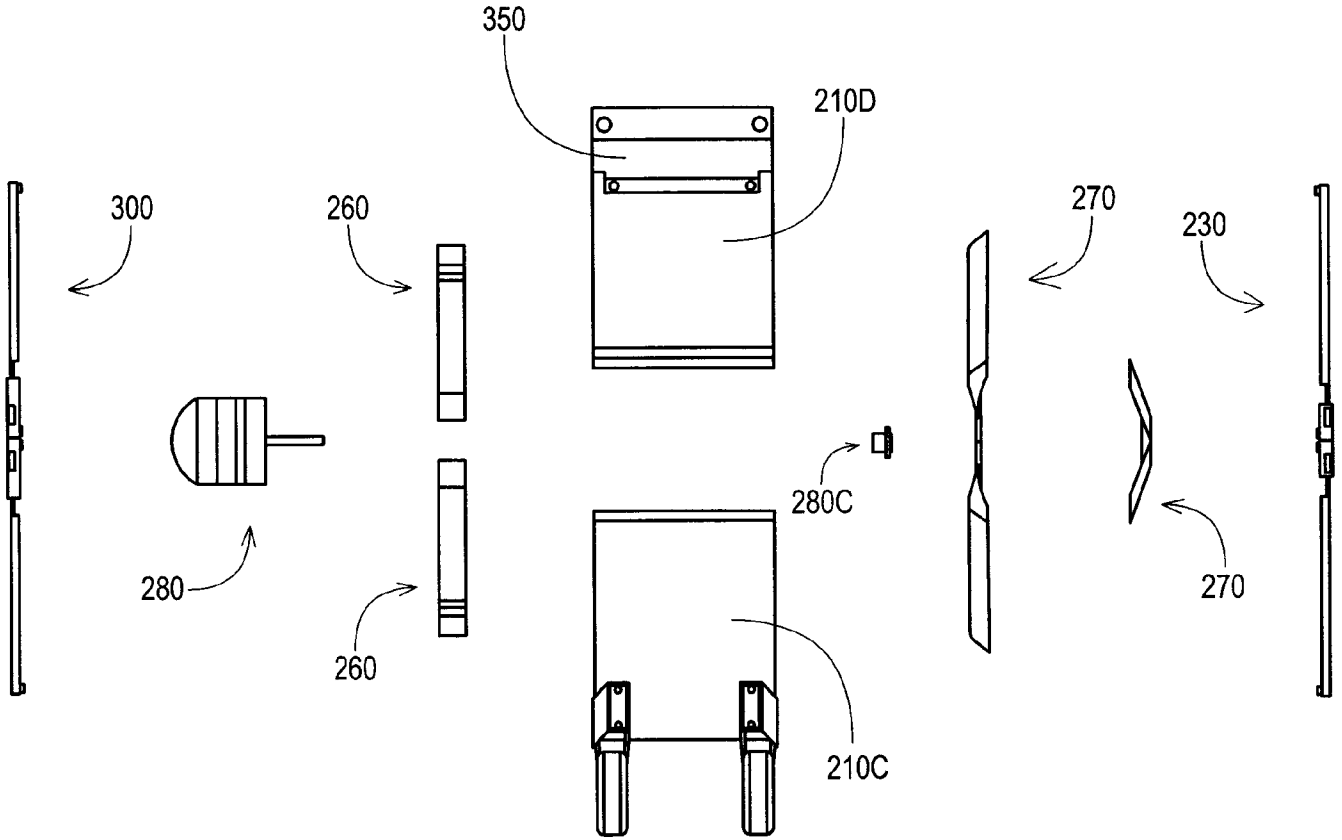
FIG. 15 is an exploded bottom side view of the knock down fan of FIG. 10.

FIG. 10 is an exploded perspective right side view of the novel modular components of a second embodiment knock down drum fan 200. FIG. 11 is an exploded perspective left side view of the knock down fan 200 of FIG. 10. FIG. 12 is an exploded right side view of the knock down fan 200 of FIG. 10. FIG. 13 is an exploded left side view of the knock down fan 200 of FIG. 10. FIG. 14 is an exploded top side view of the knock down fan 200 of FIG. 10. FIG. 15 is an exploded bottom side view of the knock down fan 200 of FIG. 10.

Referring to FIGS. 10-15, the second embodiment of the knock down drum fan 200 can be reduced to a number of modular components which will now be described. The shroud 210 can be broken down to four basic similar identical components of a first shroud member 210A, second shroud member 210B, third shroud member 210C and fourth shroud member 210D. Each shroud member can have a generally curved plate shape having a male connecting end with narrow protruding tip, and an opposite female end with receptacle portion for mateingly receiving the male end. The male connectors 212 and female connectors 218 can snap together. Alternatively, extra fasteners such as screws and the like, can attach through outer laps of the female connector ends 218 through the mail protruding portion 212 so that the male protruding tips are sandwiched therebetween. Alternatively, extra fasteners, such as screws and the like, can attach ends of the male connectors to the female connectors. Alternatively, the shroud curved plates can also be held to one another by the internal braces 260.

Hub 280 can have a motor 290 built inside (not shown), and have a main hub with non-rotatable portion 280M with outer circumferential grooves 285, a rotatable hub portion 280R with protruding rotatable axle pin 280P, and hub cap 280C. The internal hub braces 260(260A, 260B, 260C, 260D) support and attach the four outer shroud members 210(210A, 210B, 210C, 210D) to the internal hub 280. Each of the internal hub braces 260(260A, 260B, 260C, 260D), can include an outer end with raised ridge member 262 that can snap in or slide within a pair of internal facing raised flanges 215 on each of the shroud members 210A-210D. The raised ridge members 262 can have enlarged heads that can also be gripped by sliding through ends of internal facing parallel flanges 215 that have gripping edges that wrap about the enlarged heads of the raised ridge members 262, or alternatively, snap into the flanges 215.

Each of the internal hub braces 260(260A, 260B, 260C, 260D), can include an inner arc portion 265 that can fit within and wrap about the outer circumferential grooves 285 of the hub 280. Each of the inner arc portions 265 of the four internal hub braces 260(260A, 260B, 260C, 260D), can attach to one another by having male protruding end(s) 266 that fit within, and/or snap into female receptacle end(s) 267, such as the way protruding tips 262 attach into flanges 215. Similarly, each of the connection points 262, 268 can be further locked together by extra fasteners, such as screws, bolts, and the like.

The invention can have blades 270 that includes a first blade arm 270A with blade ends 272, 278, and a second blade arm 270B with blade ends 272, 278. Each of the blade arms 270A, 270B, and have an central portion plate portion 274 with through-hole 275 that allows the blade arms to be tightly sandwiched together at the central plate portion, where the through-hole 275 fits over the pin axle 280P of the hub 280. The cap 280C can lock the blades 270A, 270B to the hub 280. When assembled, the blade ends 272, 278 on each of the blade arms 270A, 270B form four blades 272, 278 on each blade arm 270A, 270B equi-distant from one another.

The front grill 230 can be formed from four identical arc shaped grill members 230A, 230B, 230C, 230D, each having side ends perpendicular to one another, so that the ends of each arc grill member to hook one another to form a disc shape. Each of the side ends can have rounded (curved edges) that allow the grill members to overlap and hook to one another. Alternatively, the arc shaped grill members can attach to one another by the interconnecting male and female connector ends, and other types of connections similar to that described in the previous embodiment. Front grill braces 240(240A, 240B, 240C, 240D) can be located outside and over the connection points of grill members 230(230A, 230B, 230C, 230D) to cover the hook connection points on the grill members. Each of the grill braces 240(240A, 240B, 240C, 240D) can have an inner facing end with male protruding tip 242 that fits within a circumferential groove 225 about front grill cap 220, and an outer bent hook end 248 that wraps about side raised edges 213 of the shroud members 210.

The back/rear grill 300 can be formed from four identical arc shaped grill members 300A, 300B, 300C, 300D, each having side ends with exteriors generally perpendicular to one another, so that the ends of each arc grill member hook one another to form a disc shape. Each of the side ends can have rounded (curved edges) that allow the grill members to overlap and hook to one another. Alternatively, the arc shaped grill members can attach to one another by the interconnecting male and female connector ends, and other types of connections similar to that described in the previous embodiment. Rear/back grill braces 340(340A, 340B, 340C, 340D) can be located outside and over the connection points of grill members 300(300A, 300B, 300C, 300D) to cover the hook connection points on the grill members. Each of the grill braces 340(340A, 340B, 340C, 340D) can have an inner facing end with male protruding tip 342 that fits within a circumferential groove 229 about rear/back grill ring 228, and an outer bent hook end 348 that wraps about side raised edges 217 of the shroud members 210.

The invention can have two handles 250(250A, 250B) that can be pre-attached by fasteners (such as but not limited to screws, bolts, and the like) to the outside of shroud members 210A, 210B.

Wheels 320 can be attached to the lower rear shroud member 210C by wheel braces 310. Two wheels 320A, 320B can be attached by axle fasteners (not shown) to outer flange ends of U-shaped braces 310A, 310B. Each of the braces 310A, 310B can be attached to an exterior lower portion of shroud member 210C by fasteners, such as but not limited to screws, bolts, and the like. The two wheels 320A, 320B can be spaced apart to add stability to the assembled drum fan 1. A single front leg 350 having a generally U shape can have bent ends 352 attached to a lower exterior portion of shroud member 210D by fasteners, such as but not limited to screws, bolts, and the like. A lower end portion 355 can have a flat end with or without a rubber/elastomer tip 357.

Figure 16:
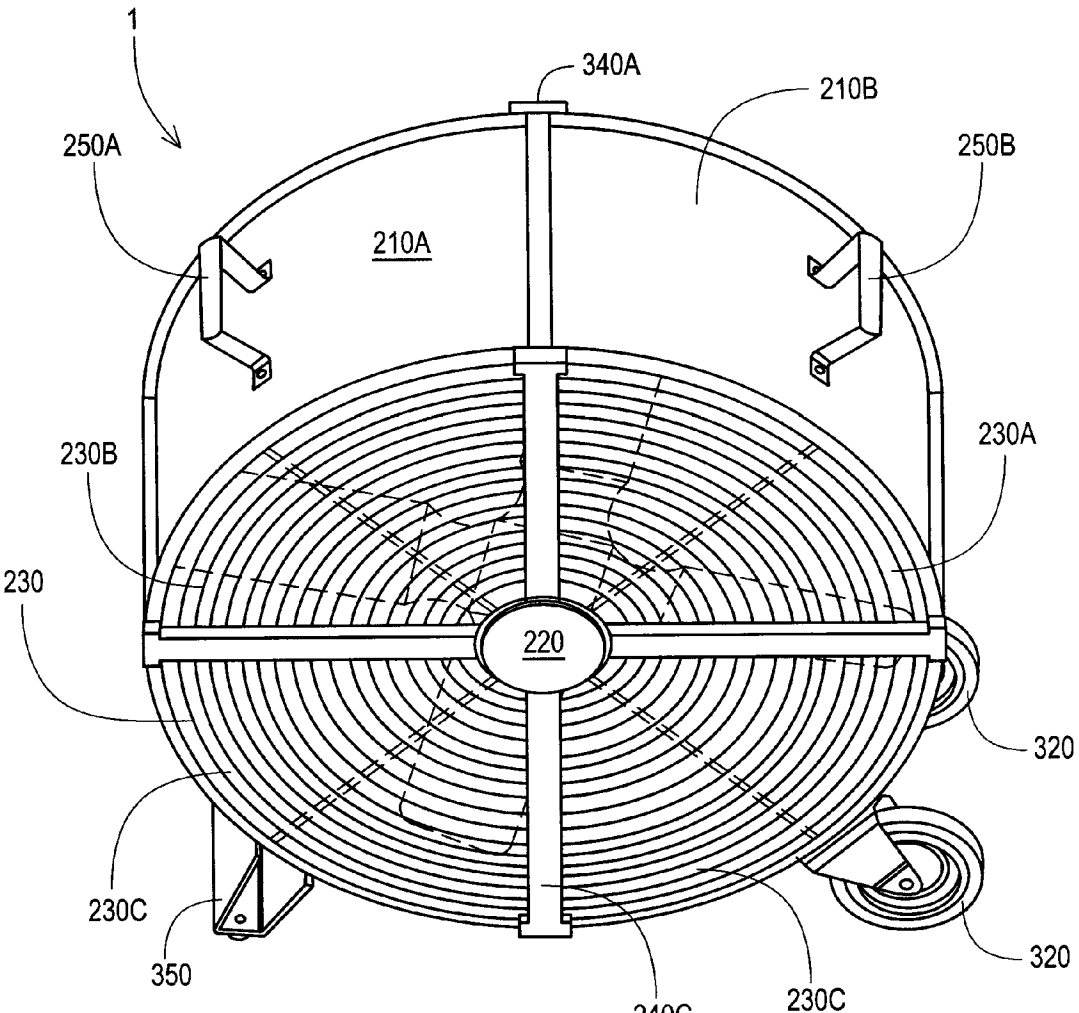
FIG. 16 is a perspective upper right side view of the second embodiment knock down drum fan of FIG. 10 assembled.
Figure 17:
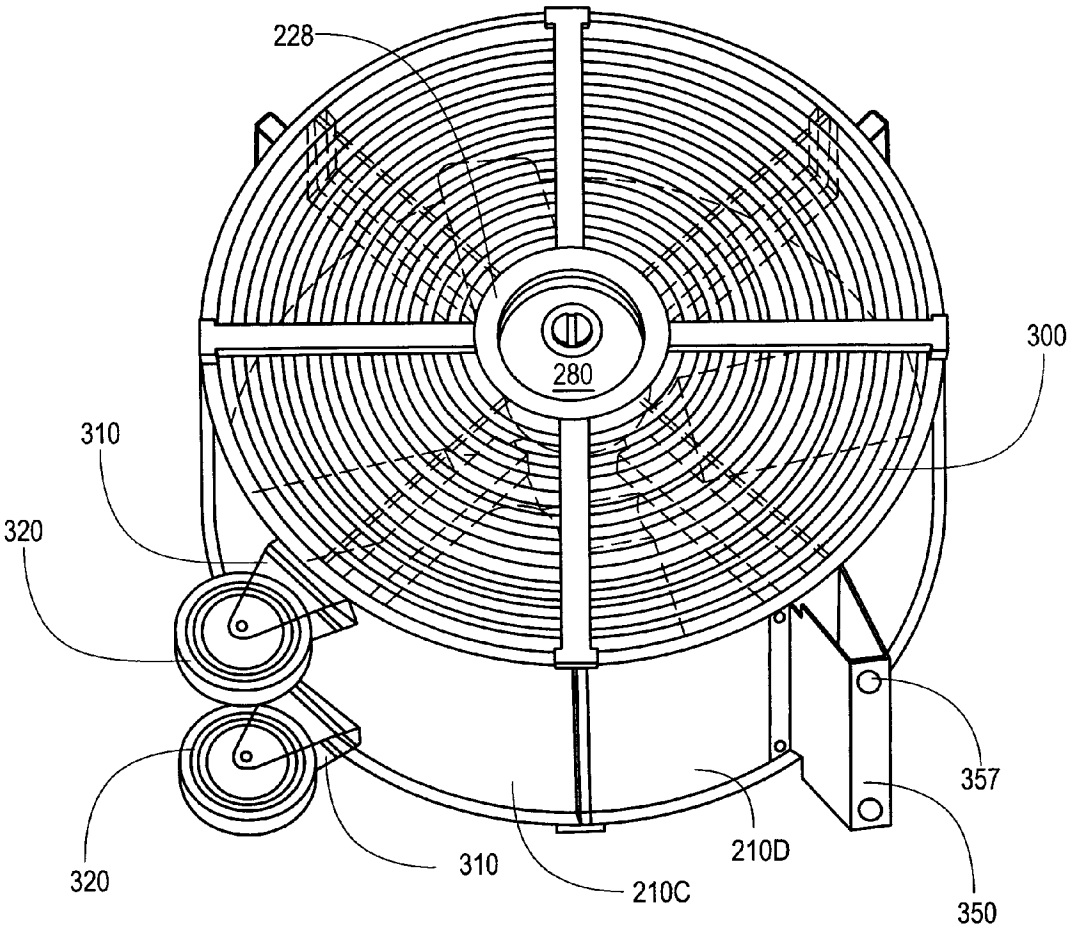
FIG. 17 is a perspective lower left side view of the second embodiment knock down drum fan of FIG. 16 assembled.
Figure 18:
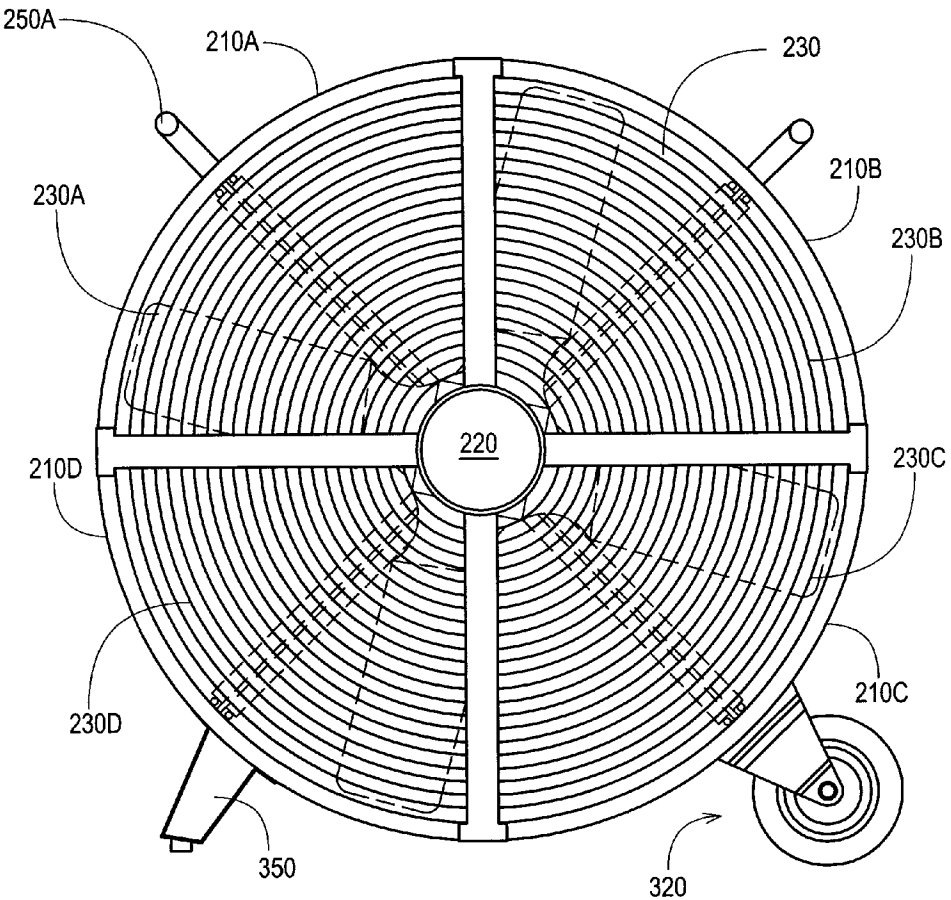
FIG. 18 is a right side view of the second embodiment of the drum fan of FIG. 16.
Figure 19:
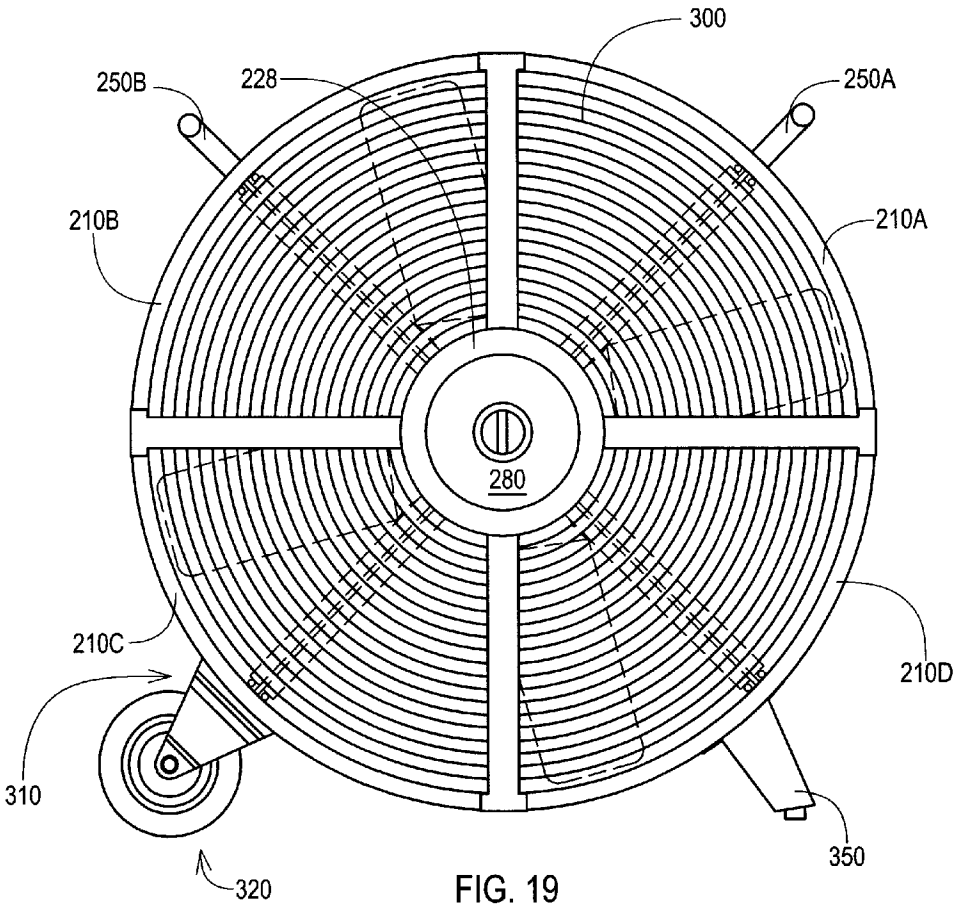
FIG. 19 is a left side view of the second embodiment of the drum fan of FIG. 17.
Figure 20:
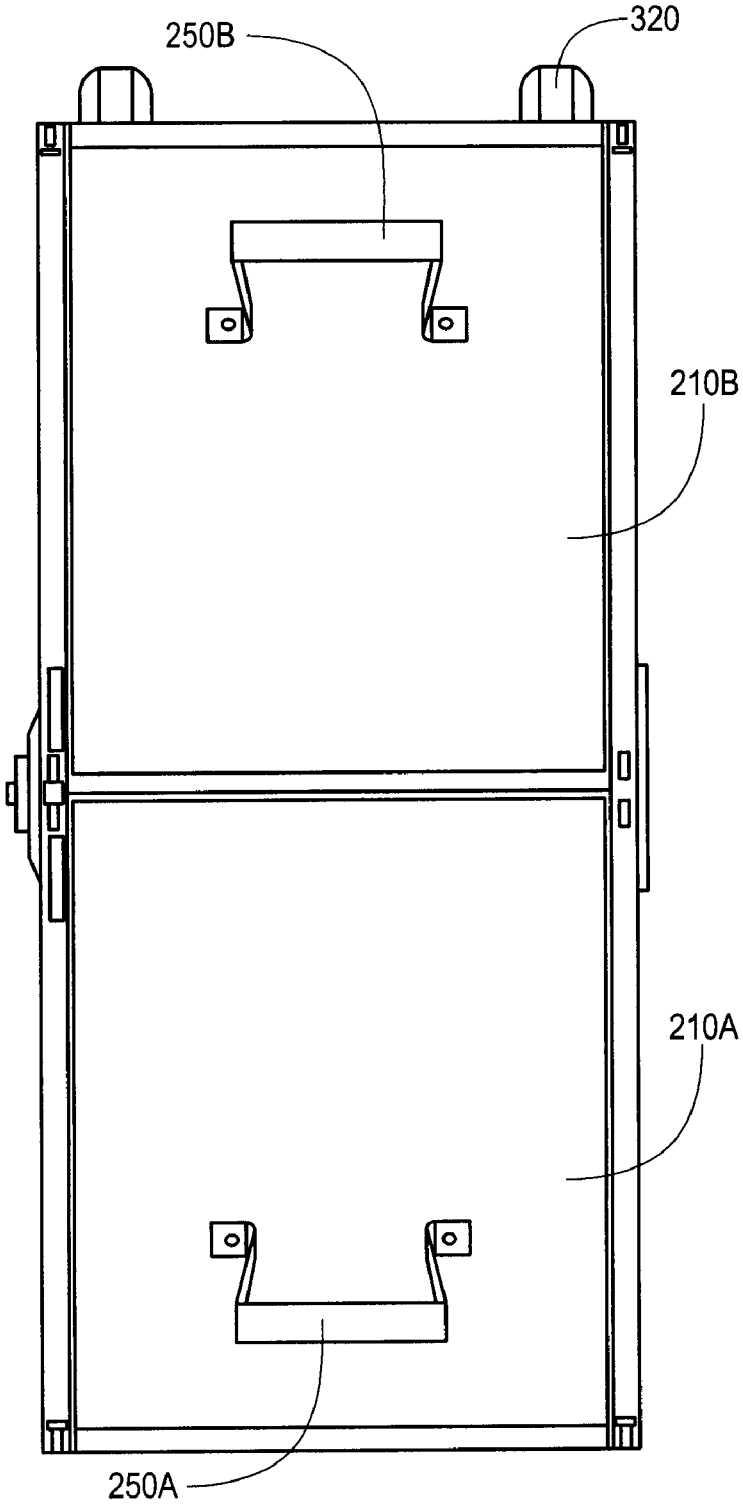
FIG. 20 is a top side view of the second embodiment of the drum fan of FIG. 10.
Figure 21:
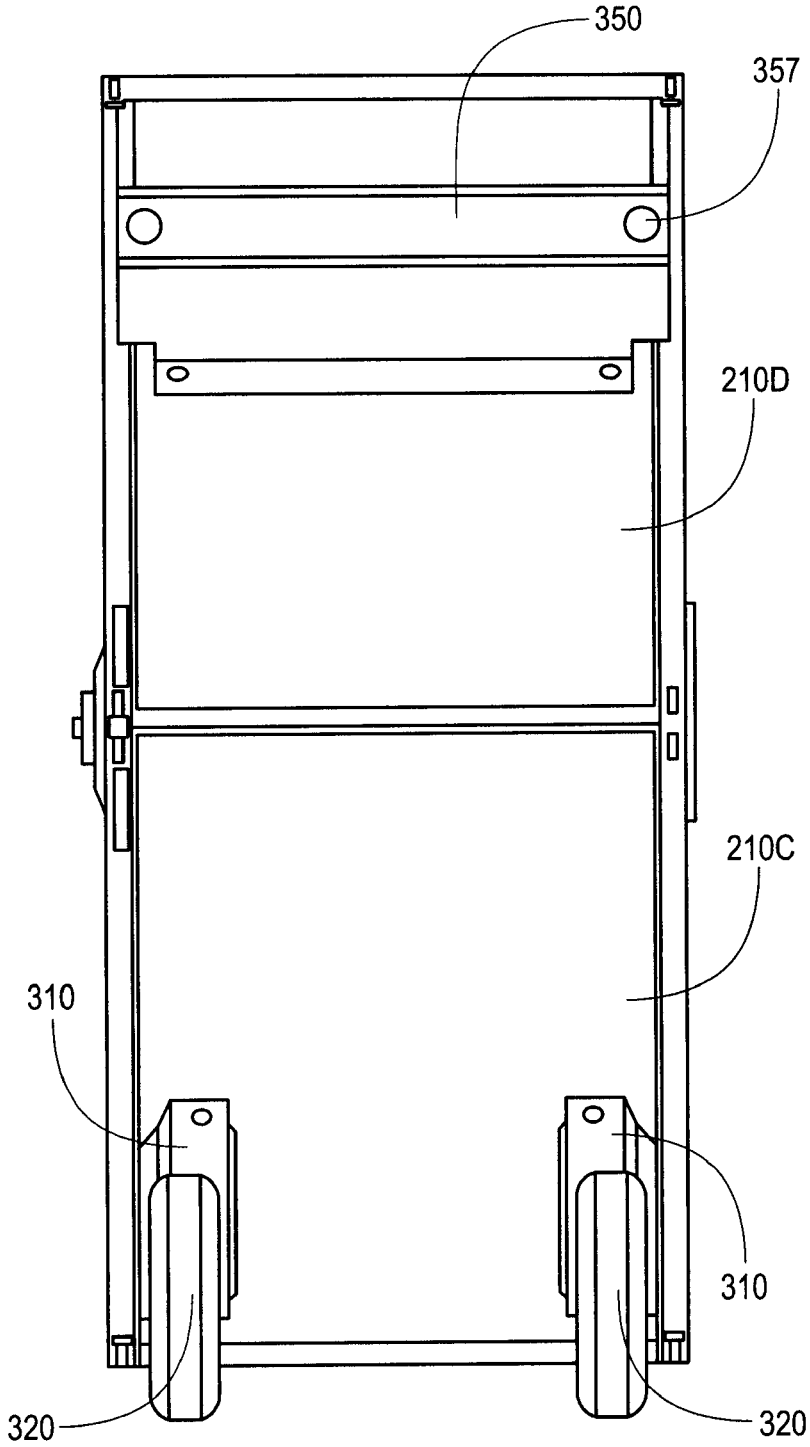
FIG. 21 is a bottom side view of the second embodiment of the drum fan of FIG. 10.
Figure 22:
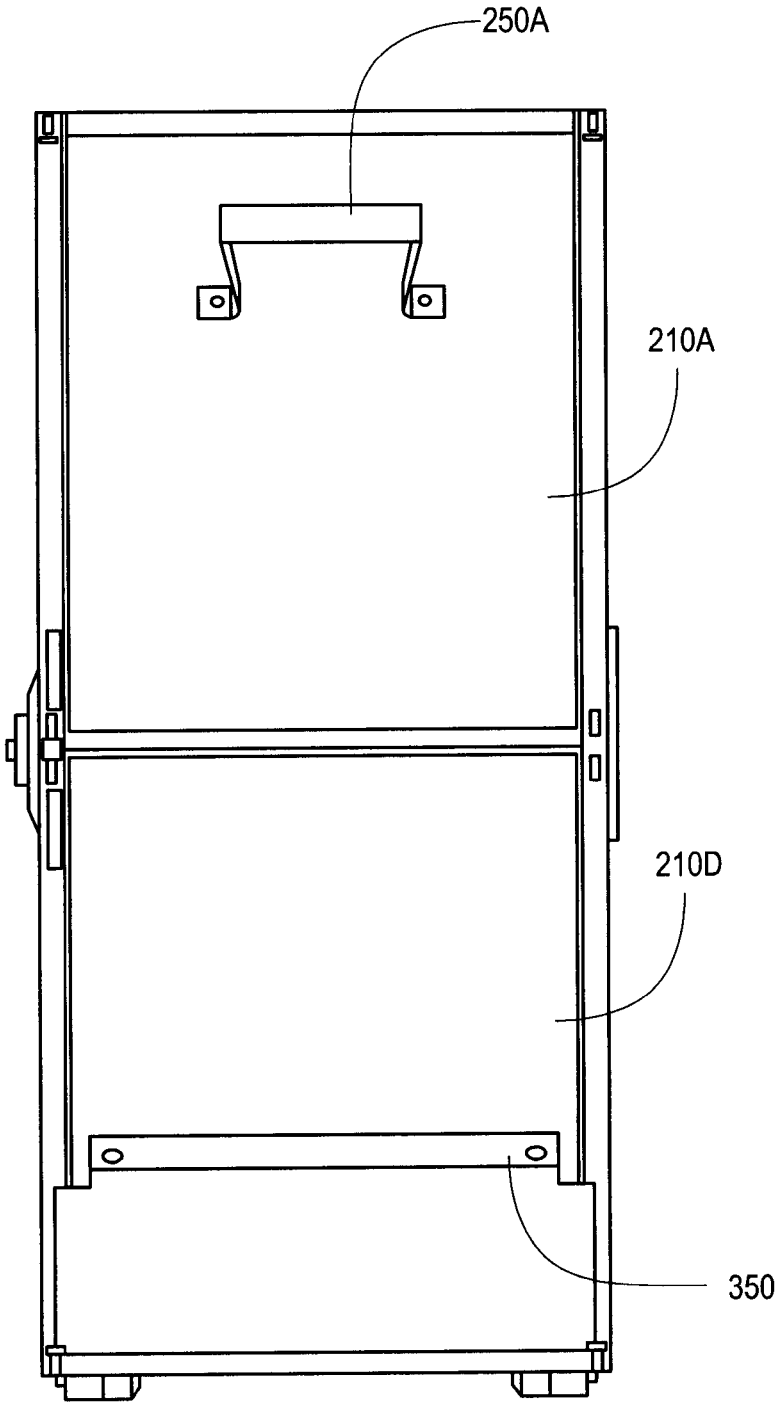
FIG. 22 is a front side view of the second embodiment of the drum fan of FIG. 10.
Figure 23:
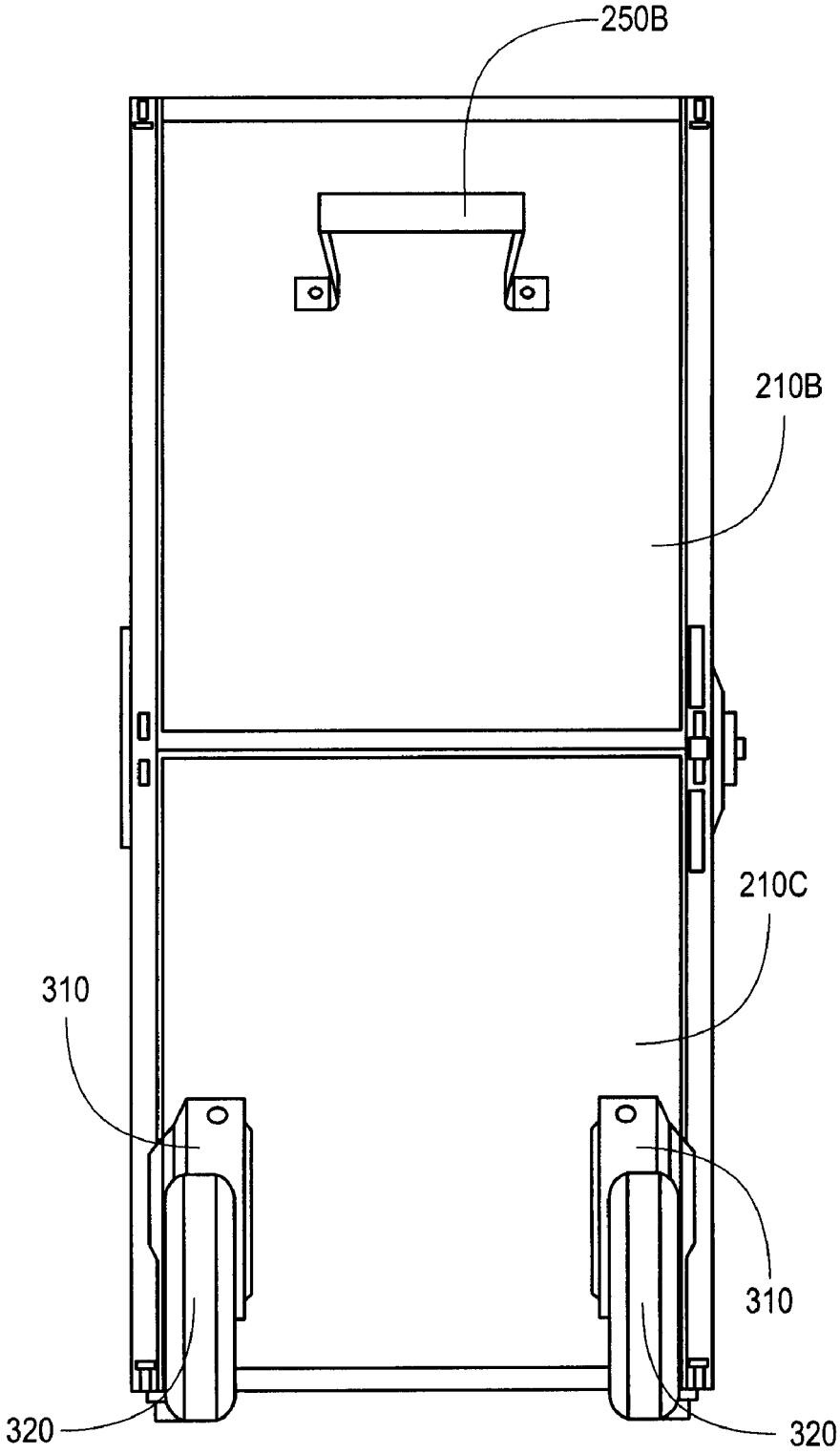
FIG. 23 is a rear side view of the second embodiment of the drum fan of FIG. 10.

FIGS. 16-23 show the modular components of exploded views of FIGS. 10-15 after being assembled. FIG. 16 is a perspective upper right side view of the second embodiment knock down drum fan 200 of FIG. 10 assembled. FIG. 17 is a perspective lower left side view of the second embodiment knock down drum fan 200 of FIG. 16 assembled. FIG. 18 is a right side view of the second embodiment of the drum fan 200 of FIG. 16. FIG. 19 is a left side view of the second embodiment of the drum fan 200 of FIG. 17. FIG. 20 is a top side view of the second embodiment of the drum fan 200 of FIG. 10. FIG. 21 is a bottom side view of the second embodiment of the drum fan 200 of FIG. 10. FIG. 22 is a front side view of the second embodiment of the drum fan 200 of FIG. 10. FIG. 23 is a rear side view of the second embodiment of the drum fan 200 of FIG. 10.

As an additional safety measure, a plurality of additional flexible and pliable fasteners such as plastic tie wraps 700 (FIG. 1) can be used to attach each of the grill section members 230, 300 to either or both the braces 340, 240, 260 shroud cover and/or the hub 80 to better lock the front grill 230 and rear grill 300 in place.

Third Embodiment

Figure 24:
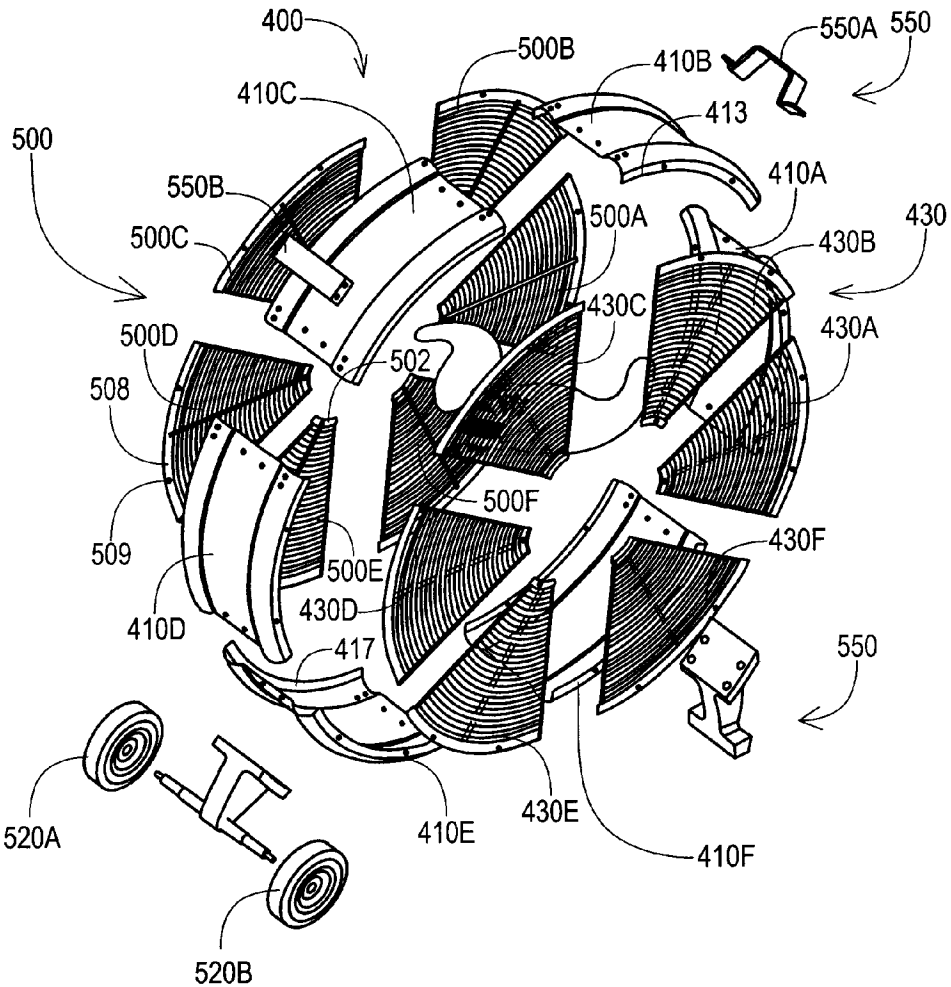
FIG. 24 is a perspective exploded view of a third embodiment knock down drum fan.
Figure 25:
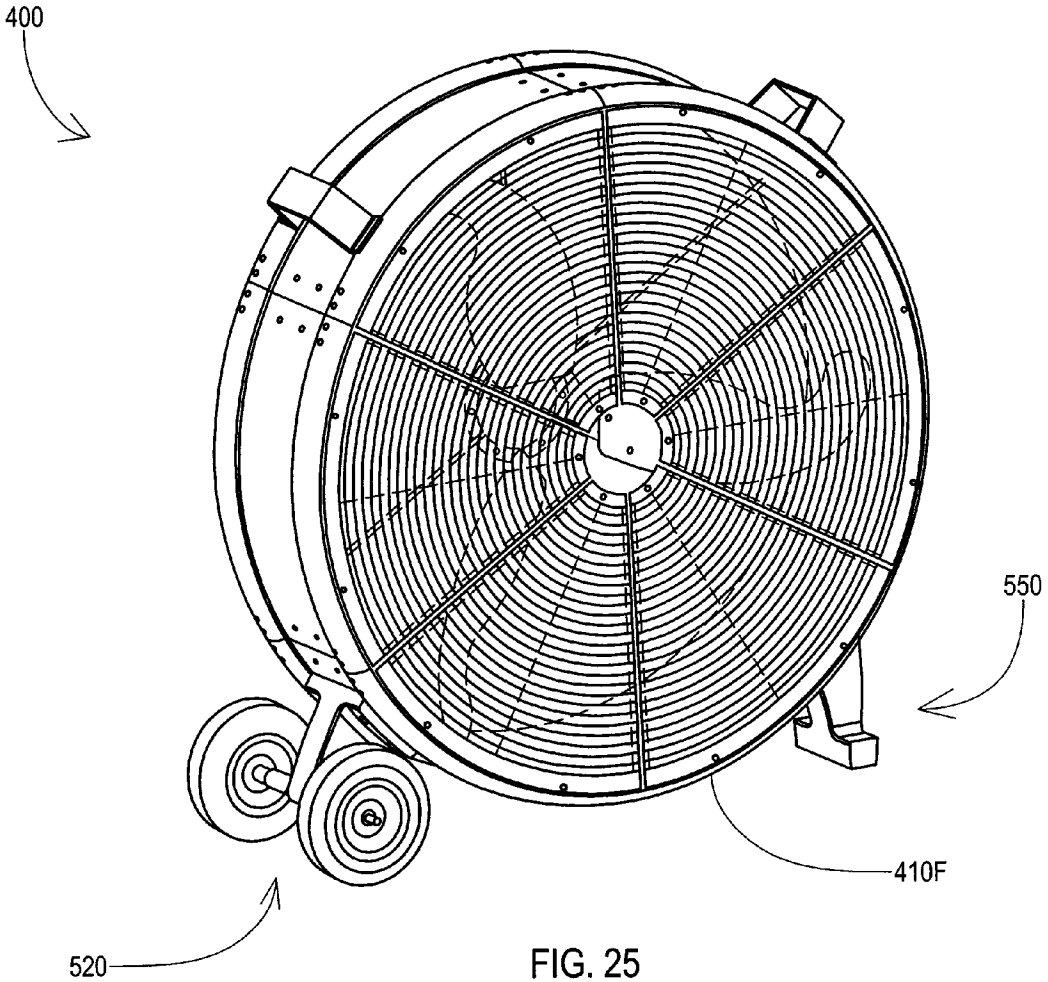
FIG. 25 is an assembled view of the knock down drum fan of FIG. 24.
Figure 26B:
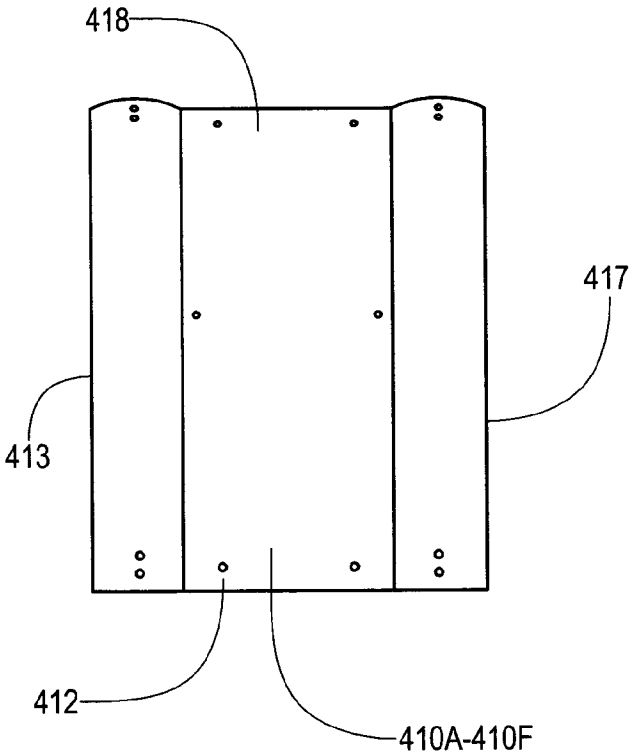
FIG. 26B is a top view of the shroud member of FIG. 26A.
Figure 26A:
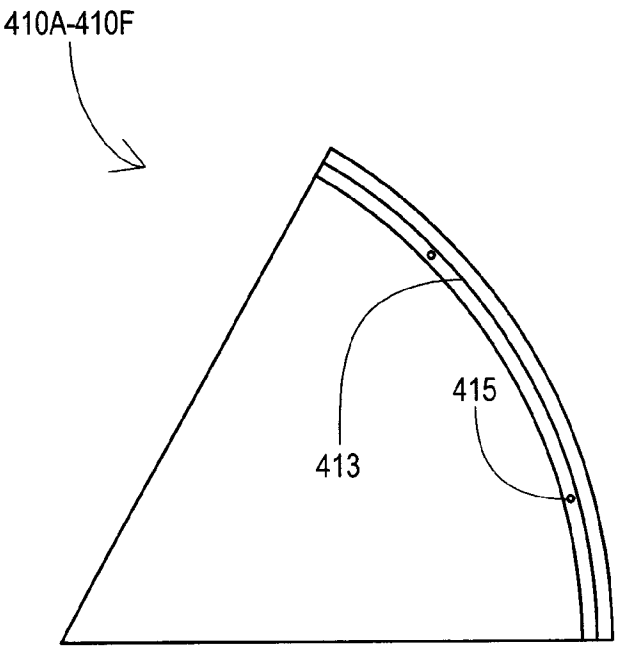
FIG. 26A is a side view of a shroud member of the knock down fan of FIGS. 24-25.

FIG. 24 is a perspective exploded view of a third embodiment knock down drum fan 400. FIG. 25 is an assembled view of the knock down drum fan 400 of FIG. 24. FIG. 26A is a side view of a shroud member 410A of the knock down fan 400 of FIGS. 24-25. FIG. 26B is a top view of the shroud member 410A of FIG. 26A.

Referring to FIGS. 24-26B, the third embodiment of the knock down drum fan 400 can be reduced to a number of modular components which will now be described. The shroud 410 can be broken down to six basic similar identical components of a first shroud member 410A, second shroud member 410B, third shroud member 410C, a fourth shroud member 410D, a fifth shroud member 410E and a sixth shroud member 410F. Each shroud member 410(410A-410F) can have a generally curved plate shape having a first overlapping end 412, and a second overlapping end 418. Fasteners such as screws and the like, can attach each of the overlapping ends 412, 418 of each of the shroud members 410A-410F to one another to form a cylindrical outer casing shroud 410. Alternatively, the shroud curved plates 410A-410F can also be supported and strengthened with one another by the internal braces such as those described in previous embodiments.

Figure 27:
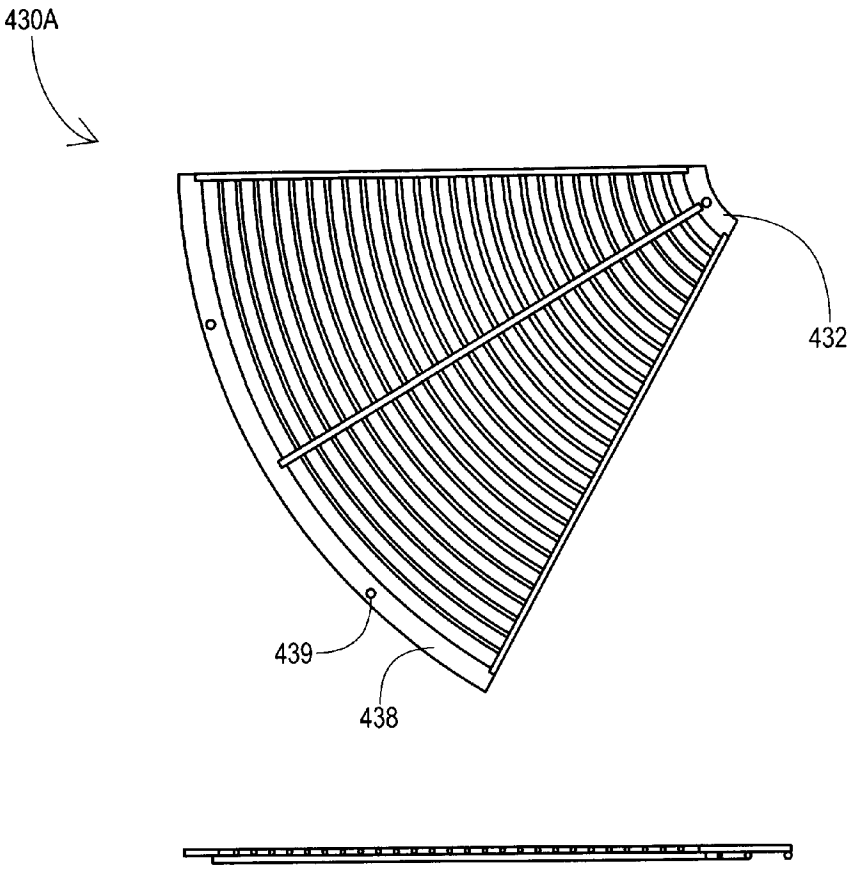
FIG. 27 is an enlarged view of a single front/rear grill member.

FIG. 27 is an enlarged view of a single front/rear grill member 430A, 500A. Referring to FIGS. 24-27, the front grill 430 can include six identical arc shaped grill members 430A, 430B, 430C, 430D, 430E and 430F each having side ends perpendicular to one another, so that the ends of each arc grill member abut to one another. The grill members 430 (430A-430F) each having inner arc ends 432 and outer flat arc ends 438 with a series of holes 439 therethrough. Each of the grill members 430(430A-430F) can be held in place by being fastened to front side bent edges 413 on each of the respective shroud members 410A-410F by fasteners, such as but not limited to screws, bolts, and the like. The inner ends 432 of each of the grill members 430(430A-430F) can be held in place by similarly being fastened to a flat shaped ring (not shown) with holes by similar types of fasteners.

The front grill 430 can include six identical arc shaped grill members 430A, 430B, 430C, 430D, 430E and 430F each having side ends perpendicular to one another, so that the ends of each arc grill member abut to one another. The grill members 430(430A-430F) each having inner arc ends 432 and outer flat arc ends 438 with a series of holes 439 therethrough. Each of the grill members 430(430A-430F) can be held in place by being fastened to front side bent edges 413 on each of the respective shroud members 410A-410F by fasteners, such as but not limited to screws, bolts, and the like. The inner ends 432 of each of the grill members 430(430A-430F) can be held in place by similarly being fastened to a flat shaped ring (not shown) with holes by similar types of fasteners.

Alternatively, each of the side ends can have rounded (curved edges) that allow the grill members to overlap and hook to one another such as those described in the previous embodiments. Alternatively, the arc shaped grill members can attach to one another by the interconnecting male and female connector ends, and other types of connections similar to that described in the previous embodiment.

The back/rear grill 500 can be formed from six identical arc shaped grill members 500A, 500B, 500C, 500D, 500E and 500F each having side ends perpendicular to one another, so that the ends of each arc grill member abut to one another. The grill members 500(500A-500F) each having inner arc ends 532 and outer flat arc ends 538 with a series of holes 509 therethrough. Each of the grill members 500(500A-500F) can be held in place by being fastened to rear side bent edges 417 on each of the respective shroud members 410A-410F by fasteners, such as but not limited to screws, bolts, and the like. The inner ends 502 of each of the grill members 500(500A-500F) can be held in place by similarly being fastened to a flat shaped ring (not shown) with holes by similar types of fasteners.

As an additional safety measure, a plurality of additional flexible and pliable fasteners such as plastic tie wraps 700 (FIG. 1) can be used to attach each of the grill section members 430, 500 to each other, and/or to any braces, and/or to the shroud cover 410 to better lock the front grill 430 and rear grill 500 in place.

Alternatively, each of the side ends can have rounded (curved edges) that allow the grill members to overlap and hook to one another such as those described in the previous embodiments. Alternatively, the arc shaped grill members can attach to one another by the interconnecting male and female connector ends, and other types of connections similar to that described in the previous embodiment.

The invention can have two handles 550(550A, 550B) that can be pre-attached by fasteners (such as but not limited to screws, bolts, and the like) to the outside of shroud members 410B, 410C.

Figure 28A:
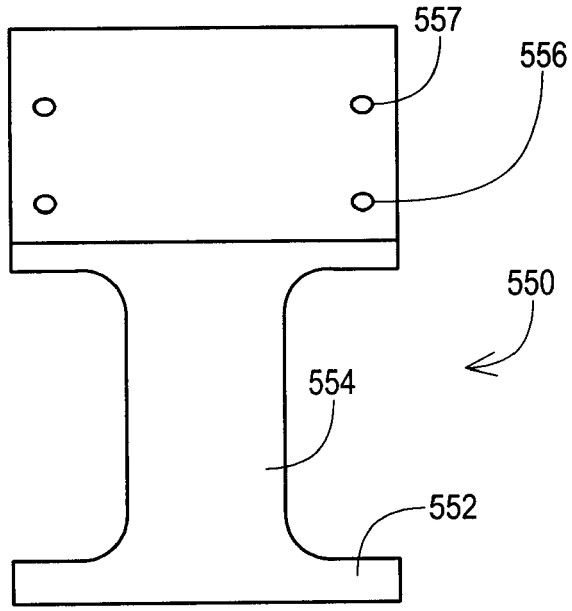
FIG. 28A is a front view of the leg member for the drum fan of FIGS. 24-25.
Figure 28B:
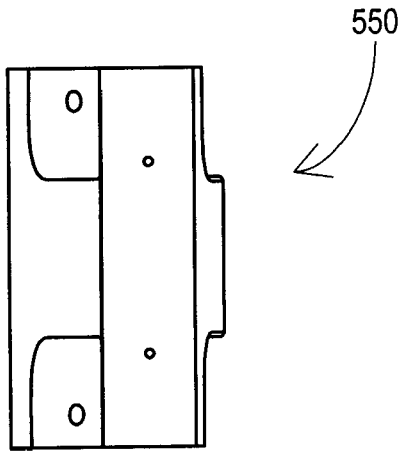
FIG. 28B is a bottom view of the leg member of FIG. 28A.
Figure 28C:
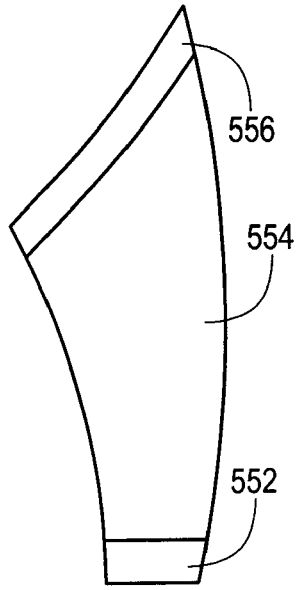
FIG. 28C is a side view of the leg member of FIG. 28A.

FIG. 28A is a front view of the leg member 550 for the drum fan 400 of FIGS. 24-25. FIG. 28B is a bottom view of the leg member 550 of FIG. 28A. FIG. 28C is a side view of the leg member 550 of FIG. 28A. Referring to FIGS. 24, 25 and 28A-28C, the drum fan 400 can include a single leg 550 having an I shape with a footer portion 552 and a header portion 556 having a similar width. The footer portion can have a narrower depth with the connection portion 554 widening out to the header portion 556. The upper surface of the header portion 556 can have a concave curved surface and through holes 557, for allowing a flush fit with fasteners (such as but not limited to screws, and bolts) to the under surface of shroud member 410F. Referring to FIGS. 24-25, wheels 520 (520A, 520B) can be attached to the lower rear shroud member 410E by I shaped wheel brace 510, that is similar in shape to leg member 550 and that can have an upper header portion 512 with a concave curved surface and through-holes for being fastened to shroud member 410E. The header portion 512 can have a depth that tapers down to a lower portion 514 that has first wheel axle 510A and second wheel axle 510B, each for holding respective wheels 520A, 520B thereon.

Figure 29:
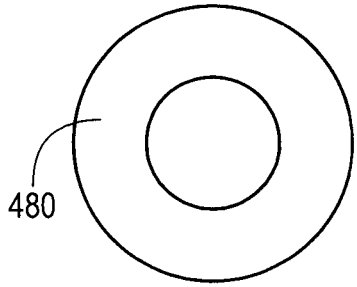
FIG. 29 is a hub ring of the drum fan of FIGS. 24-25.
Figure 29A:
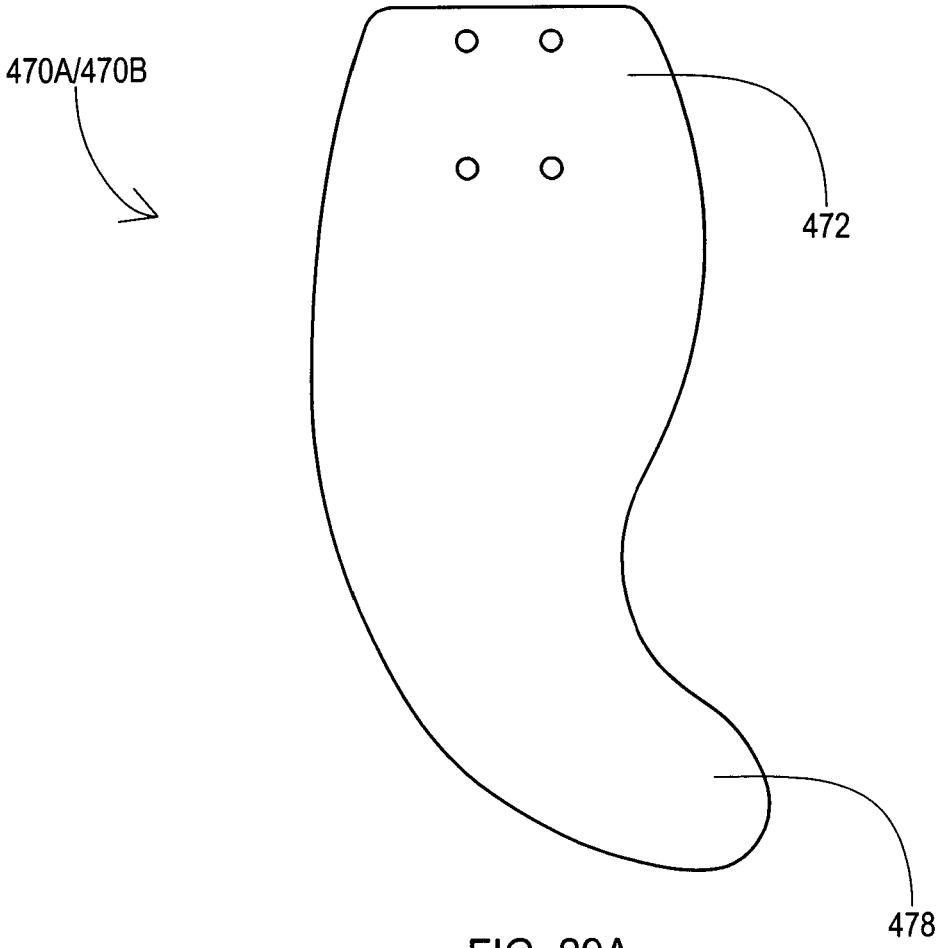
FIG. 29A is a planar view of one of the fan blades of the drum fan of FIGS. 24-25.

FIG. 29A is a planar view of one of the fan blades 470A/470B of the drum fan 400 of FIGS. 24-25. The drum fan 400 can use two blades 470A, 470B, or three identical blades or four identical blades. Each of the blades 470A, 470B can have an inner flat end 472 with through-holes that can attach by fasteners (such as screws, and bolts) to a hub ring 480 (FIG. 29) also having through-holes. Similarly, the drum fan 400 can use blades such as those described in the previous embodiments. The drum fan 400 can include a hub and motor such as those previously described in the previous embodiments and similarly attached and held in place.

Figure 30:
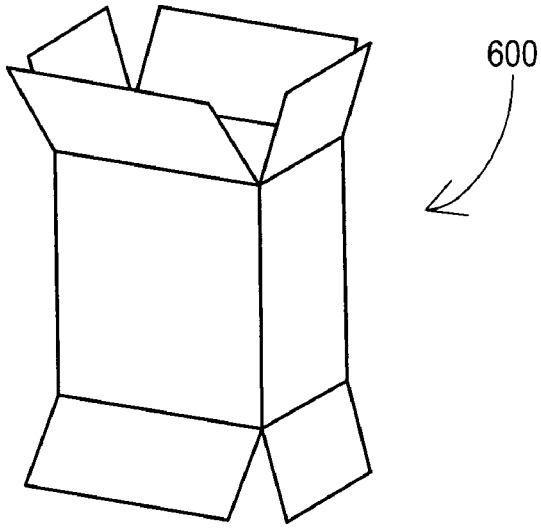
FIG. 30 is a perspective view of a packing container that can hold the modular components of the knock down drum fan.
Figure 30A:
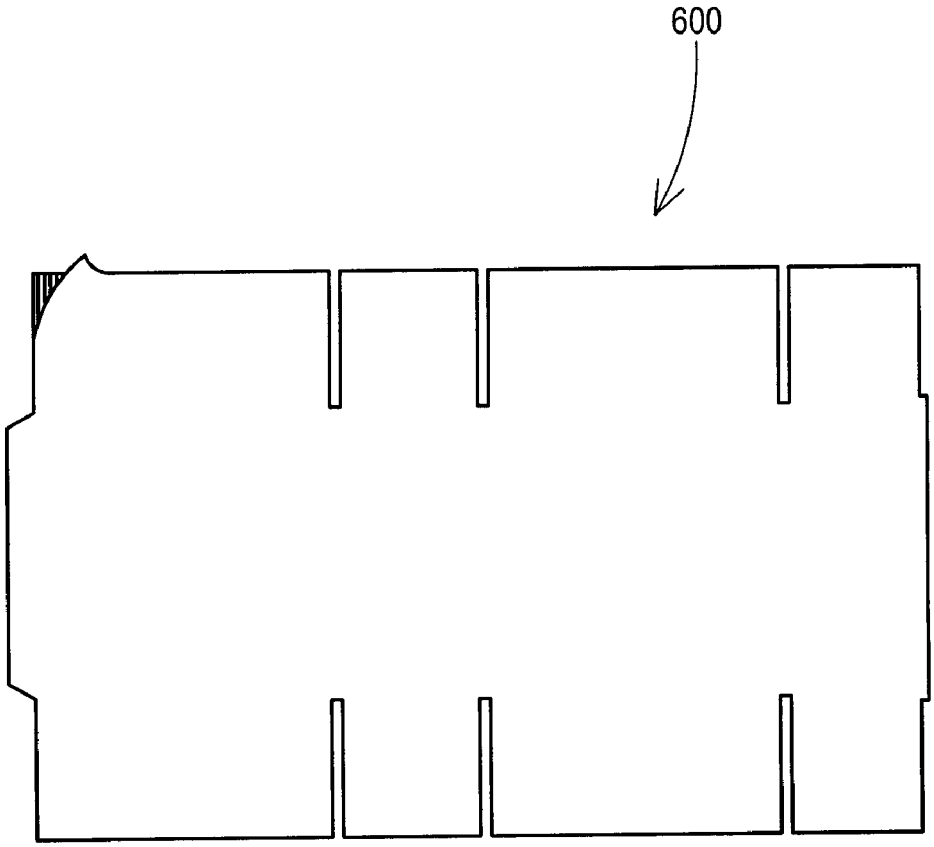
FIG. 30A shows a layout of the packing container of FIG. 30.

As previously described, the main components (front grill, rear grill, hub housing) can each be broken down into separate modular components that can be assembled by the distributor and/or the end user. FIG. 30 is a perspective view of a packing container 600 that can hold the modular components of the knock down drum fan of any of the previous embodiments. FIG. 30A shows a layout of the packing container 600 of FIG. 30. A 24 inch knock down drum fan according to the invention can be packed into a container having outer dimensions of approximately 410 mm by approximately 410 mm by approximately 258 mm, with the inner size of the container having dimensions of approximately 394 mm by approximately 394 mm by approximately 238 mm.

Although, the additional flexible and pliable fasteners described in each of the above embodiments references plastic tie wraps as a preferred fastener, other types of pliable, flexible and bendable fasteners, may be used. For example, bendable and pliable wires, strings, and other materials can be used to further attach each of the front grill and rear grill members/components to each other and/or to other parts of the drum fan.

The various embodiments of the knock down drum fan can be used to form drum fans having fan diameters of any size drum fan from approximately 24", 36", and 42" up to approximately 60" in diameter. The novel modular components can allow for easy break down and followup assembly by any user.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A knock-down drum fan, comprising:

a cylindrical shroud housing having a plurality of identical curved members that attach to one another end to end to form the cylindrical shroud;

a front grill having a plurality of identical generally triangular shaped members that together form the front grill;

a plurality of front external brace members adjacent to sides of each of the identical grill members, for holding the front grill together, the plurality of front external brace members being identical in number to the plurality of the front grill members;

fan blades having a plurality of identical blade members that together form the fan blades;

a rear grill having a plurality of identical generally triangular shaped members that together form the rear grill;

a plurality of rear external brace members adjacent to sides of each of the identical grill members, for holding the rear grill together, the plurality of rear external brace numbers being identical in number to the plurality of rear grill members;

a hub for supporting fan blades within the cylindrical shroud housing between the front grill and the rear grill;

a motor inside of the cylindrical shroud housing for rotating the blades;

a front cap for covering a central opening in the front grill; and wheels attached beneath the cylindrical shroud for allowing the drum fan to be mobile, wherein the drum fan is assembled from shroud housing, the front cap, the front grill, the rear grill, the hub, the fan blades, the motor, and the wheels.

2. The knock-down drum fan of claim 1, wherein the shroud housing consists of:

four identical shroud members that assembled together form the cylindrical shroud housing.

3. The knock-down drum fan of claim 2, wherein the front grill and the rear grill each consists of:

four equal shaped grill members.

4. The knock-down drum fan of claim 1, wherein the shroud housing consists of:

six identical shroud members that assembled together form the cylindrical shroud housing.

5. The knock-down drum fan of claim 4, wherein the front grill and the rear grill consists of:

six equal shaped grill members.

6. The knock-down drum fan of claim 1, further comprising:

a plurality of handles attached to upper portions of the identical shroud members.

7. The knock-down drum fan of claim 1, further comprising:

a plurality of plastic tie wrap fasteners for attaching each of the front grill members to the drum fan, and for attaching each of the rear grill members to the drum fan.

8. The knock-down drum fan of claim 1, further comprising:

a plurality of identical cross braces that hold ends of the curved members of the shroud together, and sandwich the front grill into place within the shroud housing.

9. A knock down drum fan, comprising:

an outer shroud formed of identical separate modular components;

a front grill formed from identical separate modular components;

a plurality of front external brace members adjacent to sides of each of the identical separate modular components of the front grill, for holding the front grill together, the plurality of front external brace members being identical in number to the identical separate modular components of the front grill; and a rear grill formed from identical separate modular components;

a plurality of rear external brace members adjacent to sides of each of the identical separate modular components of the rear grill, for holding the rear grill together, the plurality of rear external numbers being identical in number to the identical separate modular components of the rear grill;

fan blades, and a motor, wherein the outer hub, front grill, rear grill, fan blades and motor can be assembled into a single drum fan, and broken down into the separate modular components.

10. The knock down drum fan of claim 9, wherein the identical separate modular components include:

four identical separate modular curved shroud sections;

four identical separate modular front grill components; and four identical separate modular rear grill components.

11. The knock down drum fan of claim 9, wherein the identical separate modular components include:

six identical separate modular curved shroud sections;

six identical separate modular front grill components; and six identical separate modular rear grill components.

12. The knock down drum fan of claim 9, further comprising:

a plurality of plastic tie wrap fasteners for attaching each of the front grill components to the drum fan, and for attaching each of the rear grill components to the drum fan.

13. The knock down drum fan of claim 9, further comprising:

a plurality of identical cross braces that hold ends of the separate modular components of the shroud together, and sandwich the front grill into place within the shroud housing.

14. A knock-down drum fan, comprising:

a cylindrical shroud housing having a plurality of identical curved members that attach to one another end to end to form the cylindrical shroud;

a front grill having a plurality of identical generally triangular shaped members that together form the front grill;

a plurality of identical cross braces that hold ends of the curved members of the shroud together and sandwich the front grill into place within the shroud housing, the plurality of identical cross braces being identical in number to the identical curved members of the cylindrical shroud;

fan blades having a plurality of identical blade members that together form the fan blades;

a rear grill having a plurality of identical generally triangular shaped members that together form the rear grill;

a hub for supporting fan blades within the cylindrical shroud housing between the front grill and the rear grill;

a motor inside of the cylindrical shroud housing for rotating the blades;

a front cap for covering a central opening in the front grill; and wheels attached beneath the cylindrical shroud for allowing the drum fan to be mobile, wherein the drum fan is assembled from shroud housing, the front cap, the front grill, the rear grill, the hub, the fan blades, the motor, and the wheels.

15. The knock-down drum fan of claim 14, further comprising:

a plurality of front external brace members adjacent to sides of each of the identical front grill members, for holding the front grill together, the plurality of front external brace members being identical in number to the plurality of the front grill members.

16. The knock-down drum fan of claim 14, further comprising:

a plurality of rear external brace members adjacent to sides of each of the identical rear grill members, for holding the rear grill together, the plurality of rear external brace numbers being identical in number to the plurality of rear grill members.

17. The knock-down drum fan of claim 14, further comprising:

a plurality of rear external brace members adjacent to sides of each of the identical rear grill components, for holding the rear grill together, the plurality of rear external brace numbers being identical in number to the plurality of rear grill components.

18. A knock down drum fan, comprising:

an outer shroud formed of identical separate modular components;

a front grill formed from identical separate modular components;

a plurality of identical cross braces that hold ends of the separate modular components of the shroud together, and sandwich the front grill into place within the shroud housing the plurality of identical cross braces being identical in number to the identical separate modular components of the outer shroud;

a rear grill formed from identical separate modular components;

fan blades, and a motor, wherein the outer hub, front grill, rear grill, fan blades and motor can be assembled into a single drum fan, and broken down into the separate modular components.

19. The knock-down drum fan of claim 18, further comprising:

a plurality of front external brace members adjacent to sides of each of the identical front grill components for holding the front grill together, the plurality of front external brace members being identical in number to the plurality of the front grill components.

* * * * *